US005290655A

United States Patent [19]

Iwasaki

[11] Patent Number: 5,290,655

[45] Date of Patent: Mar. 1, 1994

[54] METHOD FOR FORMING AN X-RAY IMAGE

[75] Inventor: Nobuyuki Iwasaki, Kanagawa, Japan

[73] Assignee: Fuji Photo Film Co., Ltd., Kanagawa, Japan

[21] Appl. No.: 929,024

[22] Filed: Aug. 13, 1992

[30] Foreign Application Priority Data

Aug. 19, 1991 [JP] Japan ..... 3-230798

[51] Int. Cl.[5] ..... G03C 5/16

[52] U.S. Cl. ..... 430/139; 430/588; 430/576; 430/966; 430/967; 430/567; 430/502

[58] Field of Search ..... 430/139, 588, 576, 966, 430/967, 567, 502

[56] References Cited

U.S. PATENT DOCUMENTS

| | | | |
|---|---|---|---|
| 3,953,215 | 4/1976 | Hinata et al. | 430/139 |
| 4,172,730 | 10/1979 | Hinata et al. | 430/139 |
| 4,585,729 | 4/1986 | Sugimoto et al. | 430/502 |
| 4,639,417 | 1/1987 | Honda et al. | 430/567 |
| 4,731,322 | 3/1988 | Suzuki et al. | 430/567 |
| 5,041,364 | 8/1991 | Dickerson et al. | 430/502 |

FOREIGN PATENT DOCUMENTS 1-179145 7/1989 Japan .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

There is disclosed a method for forming an X-ray image formed with less exposure than is customary and having an excellent resolution. The X-ray image can be formed by subjecting a light-sensitive material comprising a support, having provided thereon a light-sensitive silver halide emulsion layer containing a silver halide emulsion sensitized with a sensitizing dye represented by the following Formula (I) on only one side of the support to photographing via a green color emission fluorescent screen with a soft X-ray emitted from an X-ray generating device with a tube voltage of $25^{kv}$ to $40^{kv}$. In the characteristic curve represented by a rectangular coordinate constituted by optical density and logarithmic exposure, the average gradation shown by the gradient of a line drawn by connecting the point at which 0.25 is added to the minimum density (hereinafter referred to as Dmin) to the point at which 2.0 is added to Dmin is set at 2.8 to 3.6; the average gradation shown by a gradient of a line drawn by connecting the point at which 0.25 is added to Dmin to the point at which 0.5 is added to Dmin is set at 1.9 or more; and the maximum density is set at 2.8 to 3.3:

(I)

wherein Formula (I) are as defined in the specification.

8 Claims, 1 Drawing Sheet

METHOD FOR FORMING AN X-RAY IMAGE

FIELD OF THE INVENTION

The present invention relates to a method for forming an image of a soft organism, specifically to a method for forming an X-ray image formed with less exposure and having an excellent resolution.

BACKGROUND OF THE INVENTION

In recent years, breast cancer among women has become an increasingly serious problem. Palpation, ultrasonic image diagnosis and mammography are used for determination of the presence of a cancer of the breast. In particular, the usefulness of mammography with a fluorescent screen is becoming clear. In older mammography techniques, an X-ray film for industrial use was used to form an image directly with an X-ray but there have been the problems with this method from excessive radiation exposure and accumulation.

Mammography with a fluorescent screen has an exposure of 1/10th to 1/100th that resulting from the methods for forming an image directly with an X-ray and is very effective for reducing exposure. Therefore, it is becoming the most effective technique for detection of a cancer of the breast.

The problem with mammography with a fluorescent screen is inferior resolution. The cause thereof is an image which is fuzzed due to interception by the screen and a reduced exposure of an X-ray to increase the quantum mottle and lower the S/N ratio. Particularly in photographing a breast, a very small absorption difference of an X-ray due to a tissue change to a morbid state has to be turned into an image and a very small change to a morbid state of a fine line image has to be turned into an image, so that this reduction of the S/N ratio is a very important problem.

Various attempts have been made in order to improve resolution. In an X-ray generation device, it has been tried to turn an X-ray into a homogeneity by a molybdenum filter with a molybdenum target. In a fluorescent screen, high density loading of a fluorescent substance has been tried and adhesiveness to a film has been improved by providing the screen surface with a matting property to improve sharpness. Also, in a cassette, a carbon resin is used, so that its strength is compatible with a thinner thickness and the loss of an X-ray due to absorption thereof by the cassette has been reduced.

Various light-sensitive materials are offered so that the relationship between sensitivity and resolution may be improved.

Various improvements have been tried but the relationship between sensitivity and resolution has not yet been satisfactorily determined.

Conventional light-sensitive materials for photographing a breast are roughly classified as a low gamma type represented by (a) or a high gamma type represented by (b) in the characteristic curve of FIG. 1. In the low gamma type of (a), much information is available from the low exposure portion to the high exposure portion, but it is difficult to perceive the contrast and therefore to make a diagnosis. In the high gamma type of (b), contrast is excellent and the image needed to make a diagnosis can be obtained. However, in the high exposure portion, it is difficult to make a diagnosis because the density is too high.

In the image required for photographing a breast, a very small absorption difference in an X-ray attributable to a change to a morbid state of a mammary gland in the breast has to be turned into an image by giving contrast and at the same time, the skin line of the breast has to be clearly pictured. The low gamma type of (a) is suited to picturing the skin line. However, it has a high possibility of missing a change to a morbid state because a very small absorption difference can not be emphasized by giving contrast. On the contrary, the high contrast type of (b) is suited to picturing the inside of a breast, but the skin line can not be pictured without using a high luminance sharcastein because the densities of the skin line and back are too high.

Also, in a light-sensitive material, not only improvement in the relationship between sensitivity and resolution, but also improvement in handling properties are important factors. That is, there are various problems generated in handling, for example, pressure sensitization and desensitization, color stain of a processed light-sensitive material, residual silver, and discolorination by hypo after storage over a long period of time.

An X-ray light-sensitive material for photographing a breast is susceptible to pressure blackening and pressure desensitization marks because the light-sensitive material is folded by its own weight when it is loaded into a cassette and because mechanical force is exerted on it in an automatic exposing device or developing device in which mechanical transportation is used. Such troubles are likely to leading to serious problems in a medical diagnosis.

Various attempts at changing the physical properties of light-sensitive materials have been tried for the purpose of improving pressure sensitization and desensitization. The descriptions thereof can be found in, for example, U.S. Pat. Nos. 3,536,491, 3,775,128, 3,003,878, 2,759,821, and 3,772,032, and JP-A-53-3325 (the term "JP-A" as used herewith means an unexamined Japanese patent application), JP-A-50-56227, JP-A-50-147324, and JP-A-51-141625. In these techniques, however, while pressure desensitization is improved, deterioration of the physical properties of the binder, such as its adhesiveness, drying property and film surface scratching property, is notable and can not basically be improved.

Further, there are available as additives, the inorganic salts of chlorine and typical elements described in JP-A-2-6803, and polyhydroxybenzenes disclosed in JP-A-1-72141. In any case, however, a sufficient improvement has not yet been achieved.

An improvement in the pressure property of a silver halide emulsion itself has variously been tried. It is well known in the art that in general, solid silver halide grains having a large grain size are susceptible to pressure desensitization and that tabular grains are susceptible to transformation with pressure and generation of a pressure blackening.

Meanwhile, there is an intense need to shorten the processing time of an X-ray light-sensitive material for photographing a breast. The medical detection of a breast cancer is getting popular and the persons to be examined are increasing. Further, in a medical examination, at least 4 photographs per one person are usually taken, and therefore it is desired to process a high number of light-sensitive materials in as short time as possible.

A sensitizing dye remains when the processing time is shortened and a color stain is likely to generate. Further, silver and hypo are likely to remain and discoloration is likely to take place after storage over a long period of time. The solution of these various problems would benefit users very much.

SUMMARY OF THE INVENTION

An object of the present invention is to provide an X-ray image-forming method for photographing a soft organism, in which resolution is improved. Another object is to provide an X-ray image having improved pressure sensitization and desensitization and excellent image preservability without color stain.

These and other objects of the present invention have been achieved with a method for forming an X-ray image by subjecting a light-sensitive material containing a light-sensitive silver halide emulsion sensitized with a sensitizing dye represented by the following Formula (I) only on one side of the support, to a photographing via a green color emission fluorescent screen with a soft X-ray. The X-ray is emitted from an X-ray generating device with a tube voltage of $25^{kv}$ to $40^{kv}$. In the characteristic curve represented by the rectangular coordinate constituted by optical density and logarithmic exposure, the average gradation shown by the gradient of the line drawn by connecting the point at which 0.25 is added to the minimum density (hereinafter referred to as Dmin) to the point at which 2.0 is added to Dmin is set at 2.8 to 3.6; the average gradation shown by the gradient of the line drawn by connecting the point at which 0.25 is added to Dmin to the point at which 0.5 is added to Dmin is set at 1.9 or more; and the maximum density is set at 2.8 to 3.3:

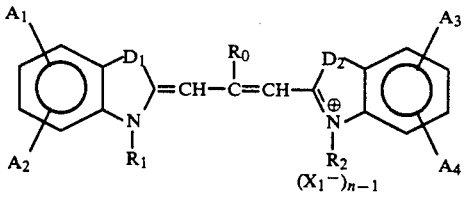

(I)

wherein $A_1$, $A_2$, $A_3$ and $A_4$ each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyl group, an acyloxyl group, an alkoxycarbonylamino group, or a carboalkoxy group; $A_1$ and $A_2$, and $A_3$ and $A_4$ may combine with each other to form a naphthoxazole group; $R_0$ represents a hydrogen atom, a lower alkyl group or an aryl group; $D_1$ and $D_2$ each represents an oxygen atom or a sulfur atom; $R_1$ and $R_2$ each represents an alkyl group, provided that at least one of $R_1$ and $R_2$ is an alkyl group having a sulfo radical; $X_1$ represents an anion; and n represents 1 or 2, provided that when n is 1, the dye forms an intermolecular salt.

| | a | b | Invention |
|---|---|---|---|
| Dmax | 3.2 | 3.9 | 3.2 |
| $\gamma_1$ | 2.4 | 2.9 | 3.3 |
| $\gamma_2$ | 1.5 | 1.7 | 2.1 |

Dmax: the maximum image density, $\gamma_1$: the average gradation shown by the gradient of the line drawn by connecting the point at which 0.25 is added to the minimum image density to the point at which 2.0 is added to the same, and $\gamma_2$: the average gradation shown by the gradient of the line drawn by connecting the point at which 0.25 is added to the minimum image density to the point at which 0.5 is added to the same.

Figure 1:
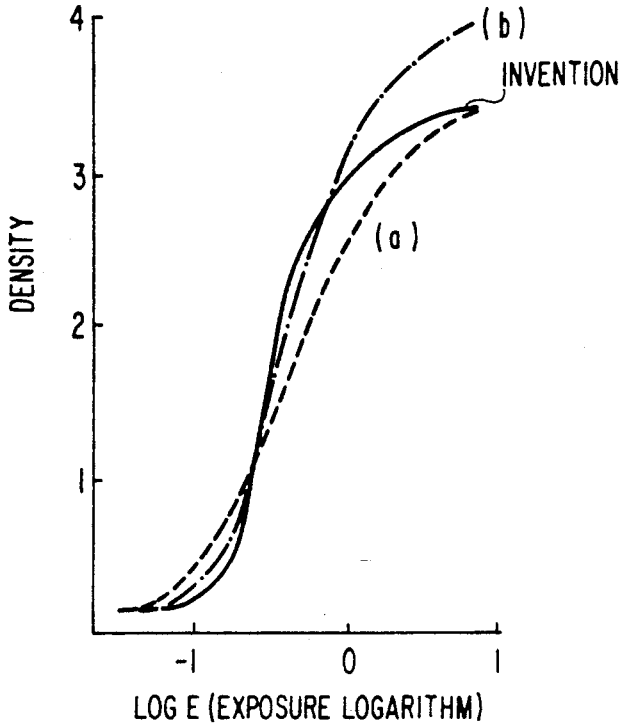
FIG. 1: the characteristic curve of a light-sensitive material prepared according to an image forming method of the present invention and the characteristic curves (a and b) of light-sensitive materials prepared according to comparative methods The values of Dmax, $\gamma_1$ and $\gamma_2$ in the above characteristic curves are shown below.
Figure 2:
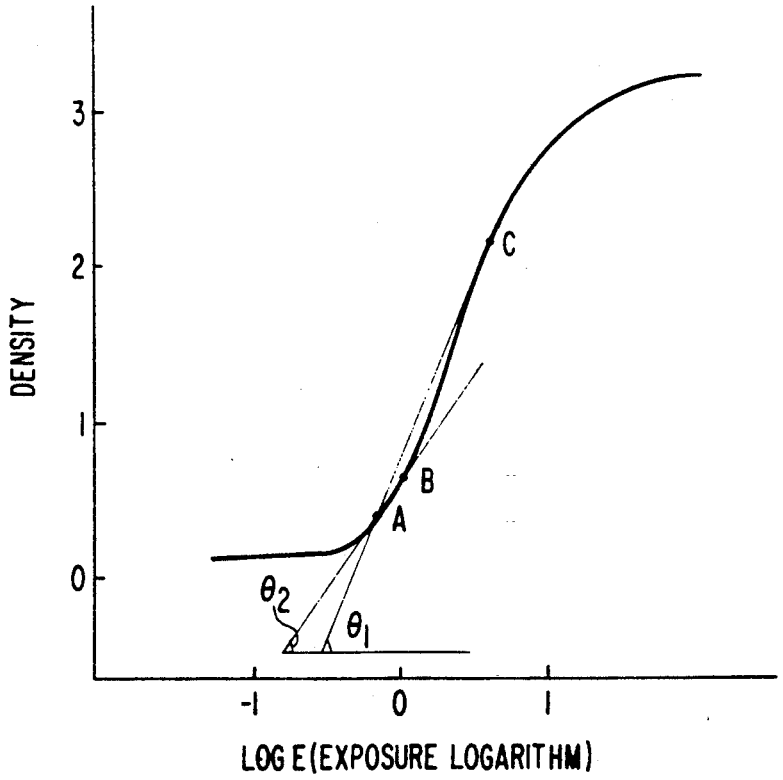

FIG. 2: the characteristic curve of a light-sensitive material prepared according to an image forming method of the present invention, wherein A, B, and C are points of Dmin+0.25, Dmin+0.5, and Dmin+2.0, respectively, $\theta_2$ is the angle at which the line drawn by connecting the point of A to the point of B intersects the exposure axis (a horizontal axis), and $\theta_1$ is the angle at which the line drawn by connecting the point of A to the point of C intersects the exposure axis tan $\theta_1$ and tan $\theta_2$ mean $\gamma_1$ and $\gamma_2$, respectively.

DETAILED DESCRIPTION OF THE INVENTION

In the present invention, a light-sensitive material is preferably processed in the following conditions, satisfying that in the characteristic curve, $\gamma_1$(Dmin+0.25−Dmin+2.0) is 2.8 to 3.6, $\gamma_2$(Dmin+0.25−Dmin+0.5) is 1.9 or more, and the maximum density is 2.8 to 3.3.

The processing is carried out with a roller transporting type automatic developing machine in the following developing solution-1 according to the following processing steps, provided that there may be allowances to some extent in the processing temperature, the processing time and the amount of the developing agent among the following conditions.

Processing conditions X:

| | Processing time | Processing temperature |
|---|---|---|
| Developing | 25 seconds | 35° C. |
| Fixing | 20 seconds | 20° C. |
| Rinsing | 20 seconds | 20° C. |
| Drying | 25 seconds | 50° C. |

Developing solution-1

| | |
|---|---|
| Potassium hydroxide | 21 g |
| $K_2SO_3$ | 63 g |
| Boric acid | 10 g |
| Hydroquinone | 25 g |
| Triethylene glycol | 20 g |
| 5-Nitroindazole | 0.2 g |
| Glacial acetic acid | 10 g |
| 5-Methylbenzotriazole | 0.05 g |
| 1-Phenyl-3-pyrazolidone | 1.2 g |
| Glutaric aldehyde | 5 g |
| KBr | 4 g |
| Water | up to 1 liter |
| pH was adjusted to | 10.20 |

Gamma defined in the present invention can be obtained from the characteristic curve drawn on a rectangular coordinate in which the coordinate axis unit lengths of the spectral density (D) and the exposure logarithm (log E) are equally settled. The above $\gamma_1$ means the gradient of the line drawn by connecting the point of a base (support) density + a fog density + the density of 0.25 to the point of the base density + the fog density + the density of 2.0. Also, the above $\gamma_2$ means the gradient of the line drawn by connecting the point of the base density + the fog density + the density of 0.25 to the point of the base density + the fog density + the density of 0.5.

Expressing these terms numerically, $\gamma_1$ and $\gamma_2$ means tan $\theta_1$ and tan $\theta_2$, respectively, wherein the angles at which these lines intersect the exposure axis (a horizontal axis) are $\theta_1$ and $\theta_2$, respectively.

In the image forming method of the present invention, an X-ray used for providing an exposure with a soft X-ray with a tube voltage of 25 to $40^{kv}$ can be generated with commercially available X-ray generating devices for mammography. These devices, which have a focus of 0.6 mm or less, are designed so that geometrical fuzz is decreased. An X-ray emitted from a molybdenum target has a lower pressure side X-ray removed by a beryllium window and has a higher pressure side X-ray removed by a molybdenum filter for the purpose of preventing a scattered ray, whereby an almost homogeneous X-ray can be obtained. A preferred image can not be obtained with a high pressure X-ray generated with a common tungsten target since the contrast of the subject is decreased and ray scattering is increased.

A commercially available fluorescent screen for a mammography can be used as the fluorescent screen. There are available, for example, HR-Mammofine manufactured by Fuji Photo Film Co., Ltd. and Min R manufactured by Eastman Kodak Co., Ltd. A fluorescent substance consisting of the rare earth elements is used in these fluorescent screens to efficiently convert an X-ray to a green ray.

Examples of the sensitizing dyes represented by Formula (I) used in the present invention are shown below but the sensitizing dyes used in the present invention are not limited thereto.

The addition amount of the sensitizing dye represented by Formula (I) is preferably 300 to 600 mg per mole of silver halide in the emulsion.

I-1

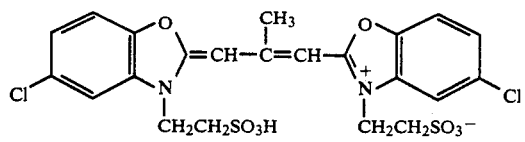

I-2

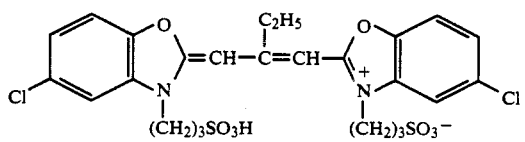

I-5

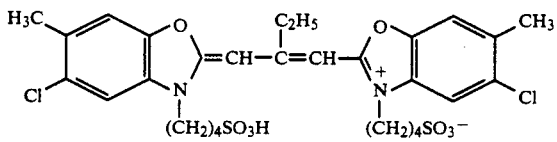

I-6

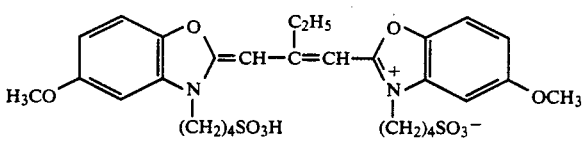

I-7

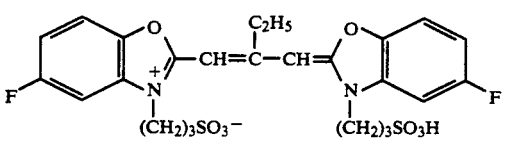

I-8

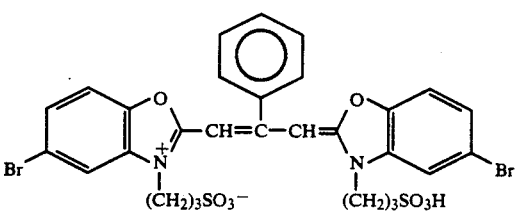

I-9

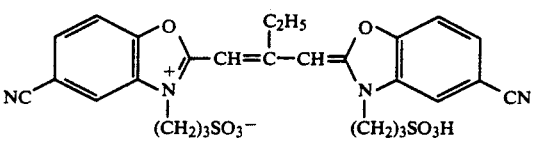

-continued
I-10
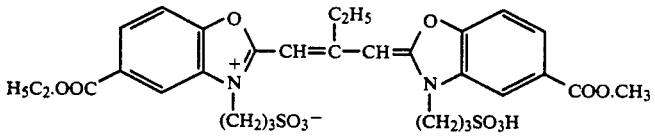
I-11
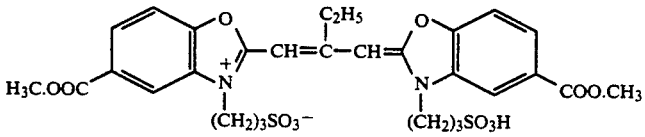
I-12
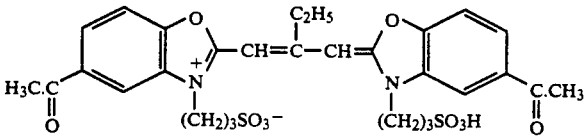
I-13
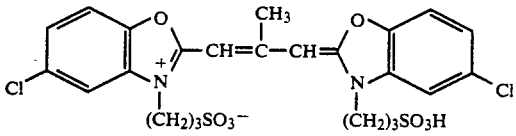
I-14
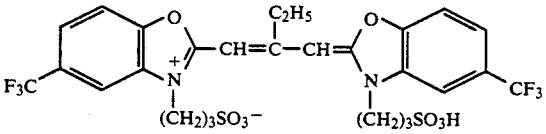
I-15
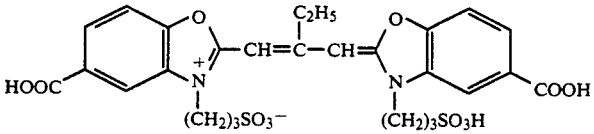
I-16
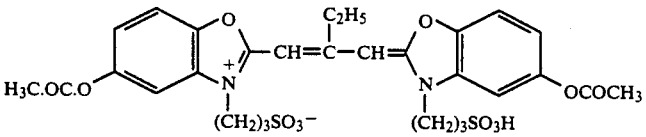
I-17
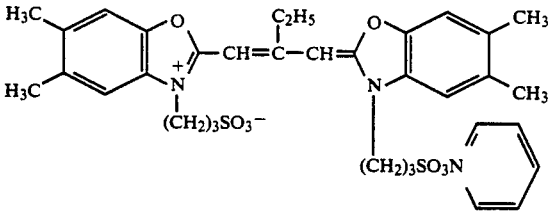
I-18
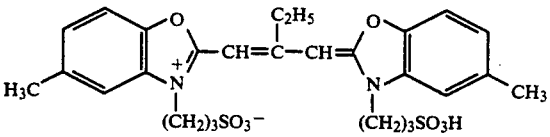
I-19
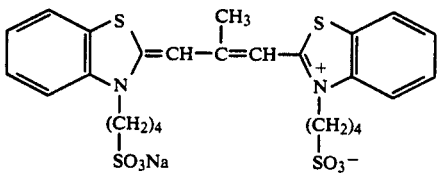

-continued
I-20
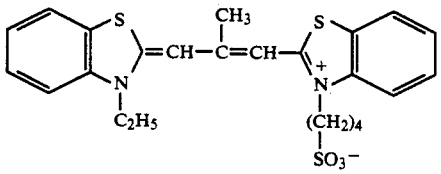
I-21
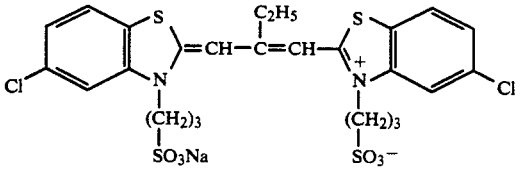
I-22
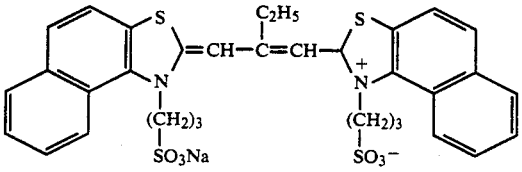
I-23
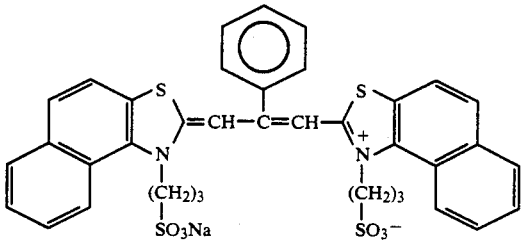
I-24
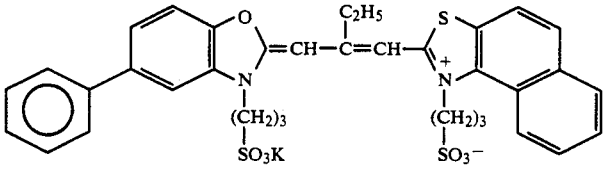
I-25
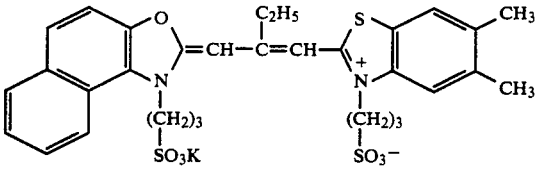
I-26
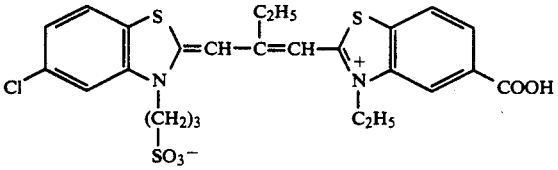
I-27
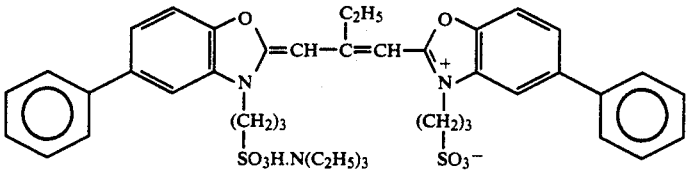

-continued

I-28

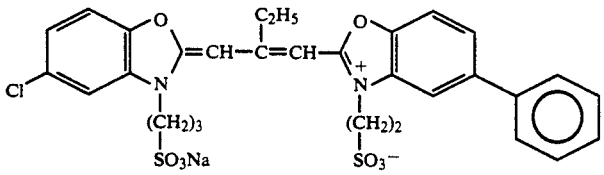

I-29

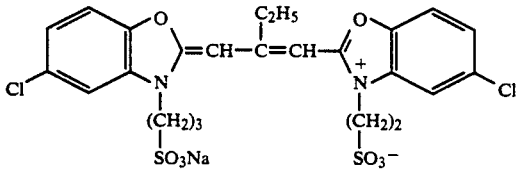

I-30

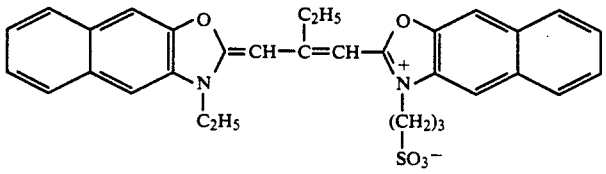

The characteristic curve according to the present invention can be determined in several different ways. It can be obtained by using a monodispersed solid grain emulsion, a monodispersed tabular grain emulsion or in combination of two or more kinds of emulsions, or by adjusting the coated silver amount and the hardening degree. The monodispersion described in the present invention is represented by the value (a fluctuation coefficient) obtained by dividing the fluctuation (a standard deviation) of a grain size represented by the diameter of a circle having an area corresponding to the projected area of the silver halide grain, with the average grain size.

A grain size distribution of an emulsion consisting of the light-sensitive silver halide grains having a uniform grain form and a small fluctuation of the grain sizes shows an almost regular distribution and therefore a standard deviation can be readily obtained.

In the present invention, the distribution of the monodispersed silver halide grains is defined by a distribution in which the fluctuation coefficient is 20% or less, preferably 15% or less.

The tabular silver halide grains described in the present invention are grains having (1) two parallel crystal planes which are substantially larger than any other single crystal planes or substantially parallel crystal planes and (2) an aspect ratio of 3 or more. The aspect ratio is shown by the ratio of the diameter to the thickness of a tabular silver halide grain. Further, the diameter of a grain is defined by the diameter of a circle having the same area as the projected area of a grain when an emulsion is observed by a microscope or an electron microscope. Also, thickness is shown by the distance between the two parallel planes constituting a tabular silver halide grain.

In the present invention, the diameter of the tabular silver halide grains is 0.3 to 3.0 μm, preferably 0.4 to 2.0 μm, and the thickness thereof is preferably 0.2 μm to 0.3 μm.

The aspect ratio of the monodispersed tabular grains contained in the emulsion according to the present invention is 3 to 10, preferably 4 to 8.

A thickness of 0.2 μm or less is not preferred since the color tone of silver is shifted to yellow. On the contrary, a thickness of 0.3 μm or more reduces the covering power of the silver image and necessitates a large amount of silver halide in order to give the needed maximum density, which deteriorates the processing property.

In a preferred embodiment for obtaining the characteristic curve according to the present invention, at least one compound represented by the following Formula (II) and/or at least one compound represented by Formula (III) is substantially (directly or indirectly) incorporated into a light-sensitive layer to obtain more preferable results:

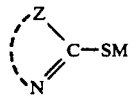

(II)

wherein Z represents a group of atoms necessary to form a 5- or 6-membered ring; and M represents a hydrogen atom, an alkali metal atom or an ammonium group;

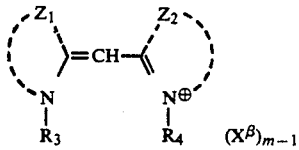

(III)

wherein, $Z_1$ and $Z_2$ each represents a group of non-metallic atoms necessary to complete a thiazole nucleus, a thiazoline nucleus, an oxazole nucleus, a selenazole nucleus, a 3,3-dialkylindolenine indolenine nucleus, an imidazole nucleus, or a pyridine nucleus; $R_3$ and $R_4$ each represents an alkyl group; $X_2$ represents an anion; and m represents 1 or 2, provided that m is 1 when the dye forms an intermolecular salt.

Examples of the compound represented by Formula (II) are shown below but the present invention is not limited thereto:

(II-1)
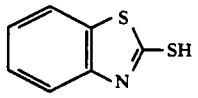
(II-2)
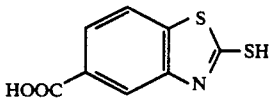
(II-3)
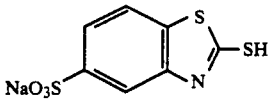
(II-4)
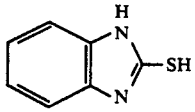
(II-5)
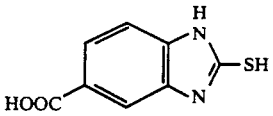
(II-6)
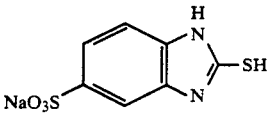
(II-7)
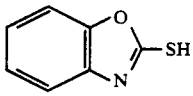
(II-8)
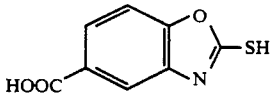
(II-9)
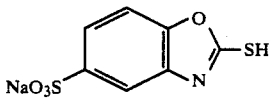
(II-10)
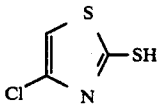
(II-11)
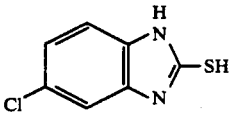
(II-12)
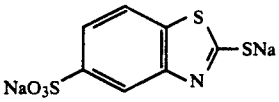
(II-13)
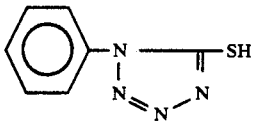
-continued
(II-14)
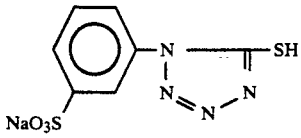
(II-15)
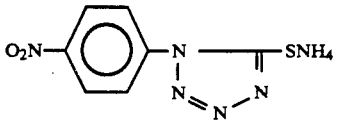
(II-16)
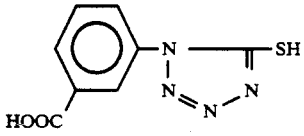
(II-17)
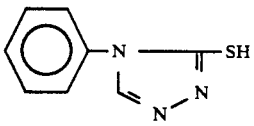
(II-18)
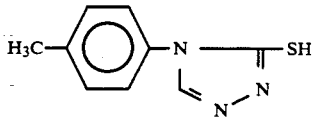
(II-19)
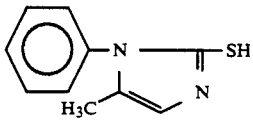
(II-20)
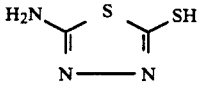
(II-21)
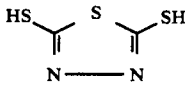
(II-22)
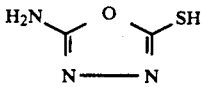
(II-23)
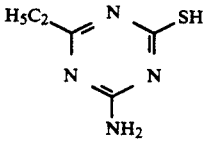
(II-24)
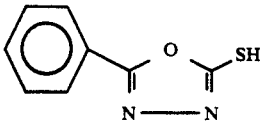
(II-25)
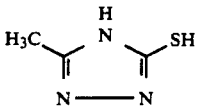

-continued (II-26)

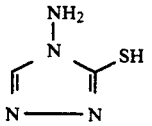

(II-27)

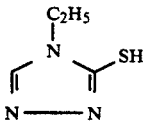

The addition amount of the compound of the present invention represented by Formula (II) is preferably $10^{-6}$ to $10^{-2}$ mole, more preferably $10^{-5}$ to $10^{-3}$ mole, per mole of silver contained in the emulsion layer.

The compound of Formula (II) of the present invention may be indirectly incorporated into a silver halide emulsion layer. That is, it may be added to other layers, for example, a protective layer from which it substantially diffuses into the emulsion layer so that the total addition amount to the emulsion layer falls within the above range.

Typical examples of the sensitizing dyes represented by Formula (III) used in the present invention are given below but the sensitizing dyes used in the present invention are not limited thereto:

III-1

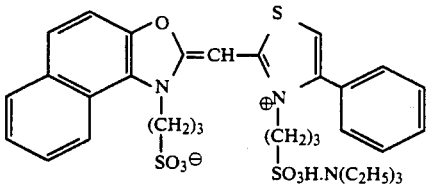

III-2

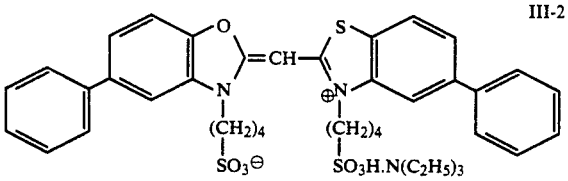

III-3

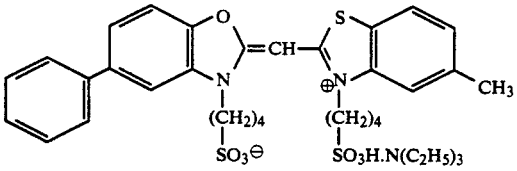

III-4

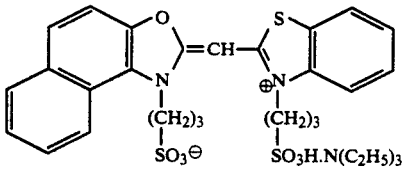

III-5

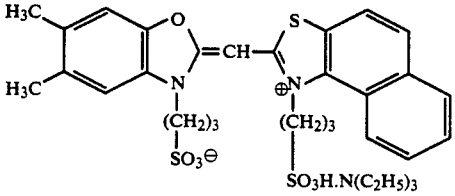

-continued

III-6

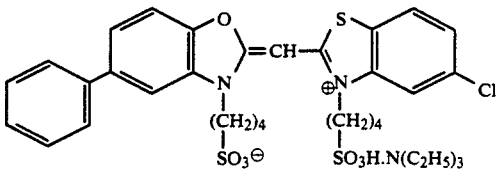

III-7

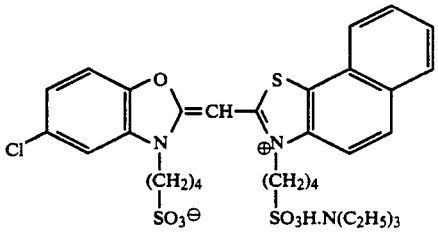

III-8

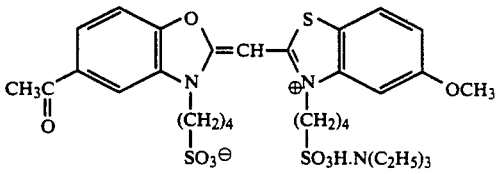

III-9

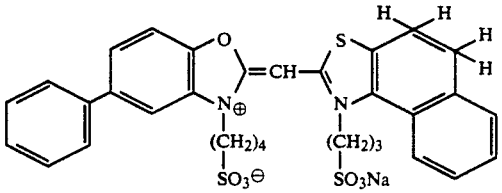

III-10

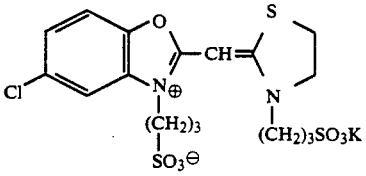

III-11

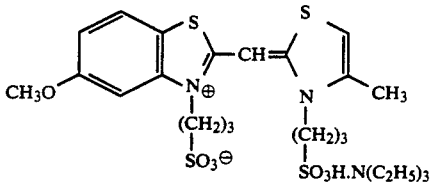

III-12

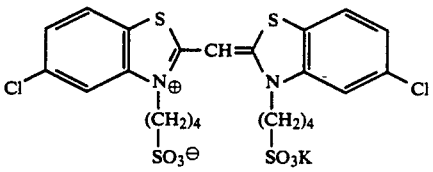

III-13

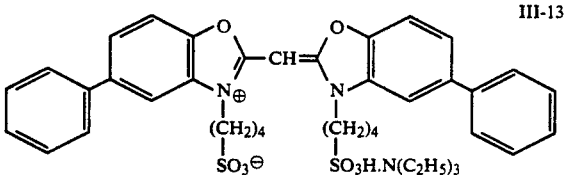

-continued
III-14
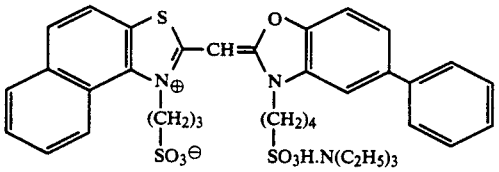
III-15
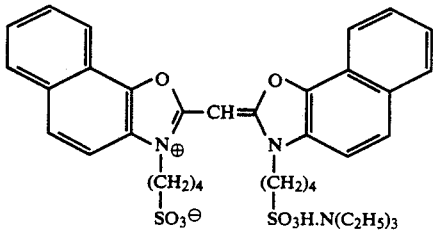
III-16
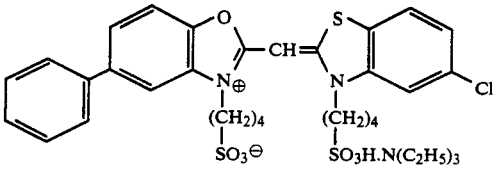
III-17
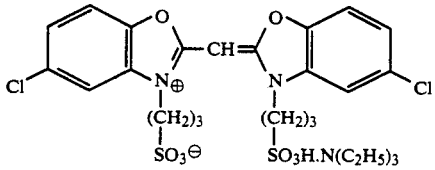
III-18
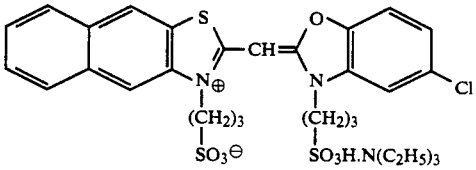
III-19
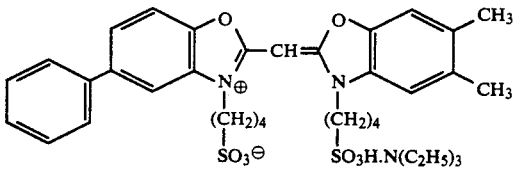
III-20
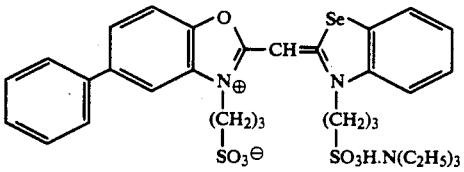
III-21
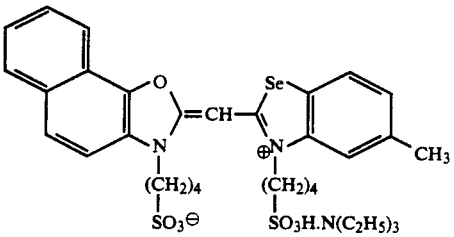
-continued
III-22
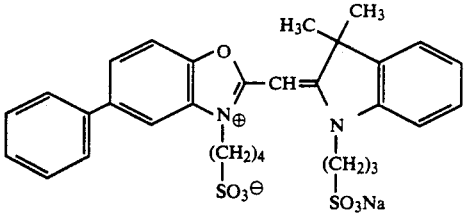
III-23
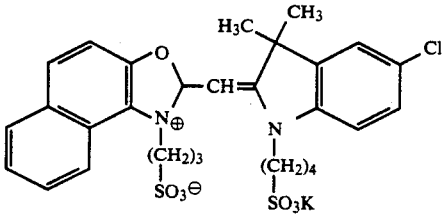
III-24
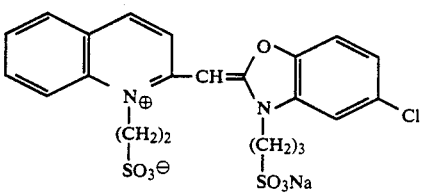
III-25
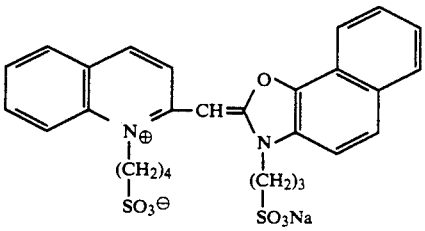
III-26
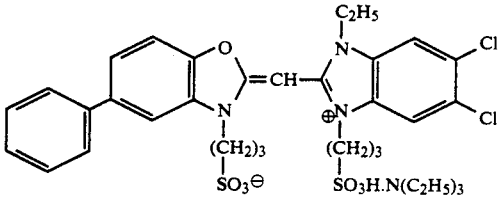
III-27
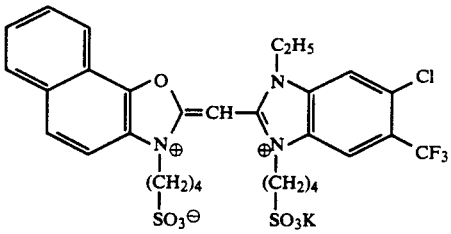
III-28
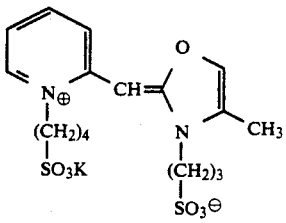

-continued

III-29

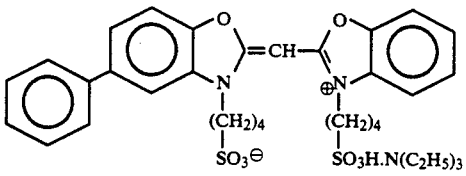

III-30

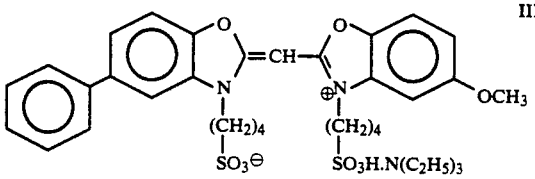

III-31

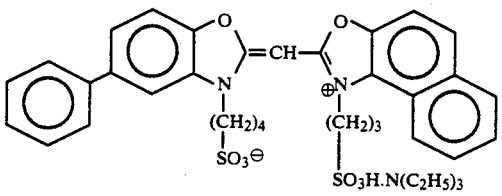

III-32

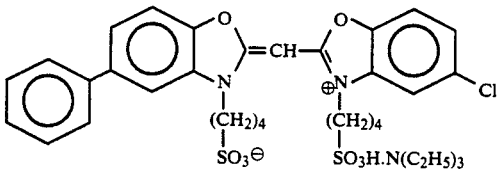

III-33

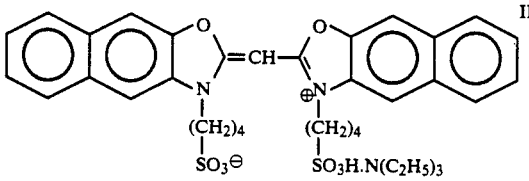

III-34

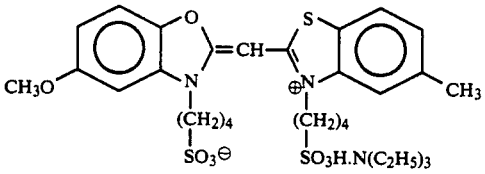

The addition amount of the sensitizing dye represented by Formula (III) is preferably 0.01 to 1 mmole, particularly preferably 0.1 to 0.5 mmole, per mole of silver halide.

A further preferred embodiment can be obtained by a light-sensitive material having a multi-layered light-sensitive layer consisting of 2 or more light-sensitive layers sensitized with a sensitizing dye of Formula (I). The sensitivity of a lower light-sensitive layer is higher by 0.1 to 0.4 in terms of relative logarithmic sensitivity than that of an emulsion contained in an upper light-sensitive layer adjacent to the lower sensitive layer. In this light-sensitive material, the further preferred sensitivity difference between the lower layer and the upper layer is 0.15 to 0.3.

In the light-sensitive material having the multilayered light-sensitive layer, an emulsion containing monodispersed tabular silver halide particles having a low average iodide content of 0.5 mole % or less is used for the lowest layer to obtain more preferred results. The examples of the silver halide include AgBr, AgBrI, and AgBrClI, and preferably AgBrI, in which Br occupies the main proportion.

Furthermore, the light-sensitive material having a plurality of light-sensitive layers, in which the light-sensitive layer closest to the support contains a monodispersed silver halide emulsion and the uppermost light-sensitive layer contains a monodispersed non-tabular emulsion having an aspect ratio of 3 or less, is preferred.

A tabular grain emulsion is preferably used since as shown in JP-A-2-838, it has many excellent photographic properties. For example, 1) the ratio (hereinafter referred to as a specific surface area) of the surface area to volume is large, and therefore a lot of a sensitizing dye can be adsorbed on the surface, which results in a relative increase of color sensitizing sensitivity;

2) where an emulsion containing tabular grains is coated and dried, the grains are disposed parallel to the surface of the support, so that the thickness of the coated layer is thinner and so that sharpness and developability can be improved;

3) where a lot of a sensitizing dye is adsorbed on the tabular grains in a Roentogen photographic system, the absorption coefficient of the dye is larger than that of an indirect transition of silver halide (AgX) and the value of the absorption coefficient × the material concentration × the thickness of the emulsion layer is large, so that crossover rays can be markedly decreased and an image quality does not deteriorate;

4) the scattering of rays can be decreased, so that an image with a high resolution can be obtained;

5) because of the mutually parallel and plain surfaces, the interference effect of rays to a parallel and plain surface can be provided and the efficiency of rays can be increased therewith;

6) a covering power is high, so that a silver amount can be saved;

7) absorption of radiation is exponentially increased against the thickness of a grain; tabular grains have a thinner thickness, so that the absorption of rays per grain is decreased and therefore an exposure to a natural irradiating ray in storage is decreased;

8) developed silver is standardized and little mottle silver is generated, so that graininess is improved; and 9) the specific surface area is large, so that development is accelerated.

The methods of preparing a monodispersed tabular silver halide emulsion are described in JP-A-63-151618, JP-A-1131541 and JP-A-1-213637. The preparation thereof is carried out according to the steps of nucleus formation, ripening and growing. Detailed explanations will be given below:

A) Nucleus formation

It is recommended to raise the probability that two twinned planes per grain are formed in parallel. In order to achieve this, the oversaturation factor in forming a nucleus is controlled. To be concrete, in forming a nucleus, one should control temperature, gelatin concentration, the adding speeds of the silver salt solution and the halide solution, pBr, $I^-$ content in the halide solution, and the silver halide solvent amount. The preferred conditions are a temperature of 15° to 45° C., a gelatin concentration of 0.1 to 4% by weight, an $AgNO_3$ adding speed of 0.5 to 15 g per liter of reaction solution, pBr of 1.0 to 2.5, the $I^-$ content of 3 mol % or less, and a silver halide solvent amount of 0 to 0.15 mol/liter.

The silver halide solvent is preferably a thioether, a thiourea or a thiocyanate.

B) Ripening

The fine tabular grain nuclei are formed during the formation of a nucleus. At the same time, a lot of fine grains other than these are formed. At this ripening step, one tries to extinguish the fine grains other than the tabular nuclei. To be concrete, one can do this by adding a silver halide solvent such as ammonia and thioether, increasing the gelatin concentration, raising the temperature of the reaction solution, and controlling pBr with the addition of a silver salt aqueous solution. The preferred conditions are a gelatin concentration of 1 to 10% by weight, a temperature of 45° to 80° C., and a pBr of 1.2 to 2.5.

C) Growing

The growing step following the ripening step is the one at which a silver salt solution and a halide solution are simultaneously added to grow the tabular grains without further generation of a nucleus. During the period of the first ⅓ or more of the crystal growing stage, pBr is maintained preferably at 1.5 to 3.5, and during the period of the first ⅓ or more of the remaining period, pBr is maintained preferably at 1.5 to 3.5. Further, the addition speed of the silver ion and the halogen ion at the crystal growing stage is preferably set at the addition speed corresponding to 20 to 100%, more preferably 50 to 100% of the critical crystal growing speed. In this case, the addition speed of the silver ion and the halogen ion is increased according to crystal growth, and the method of increasing it may be that described in JP-B-48-36890 (the term "JP-B" as used herewith means an examined Japanese patent publication) and JP-B-52-16364. Specifically, one may increase the addition speed (a flowing speed) of the silver salt aqueous solution and the halide aqueous solution each having a fixed concentration or increase the concentrations of the silver salt aqueous solution and halide aqueous solution. Further, one may increase the addition speed of the ultra fine grain emulsion with a grain size of 0.10 mm, which is prepared in advance. Also, they may be combined. The addition speed of the silver ion and halogen ion may be increased discontinuously or continuously.

The photographic emulsion used in the present invention can be prepared by the methods described in *Chimie et Physique Photographique,* written by P. Glafkides (published by Paul Montel Co., Ltd. 1967), *Photographic Emulsion Chemistry,* written by G. F. Duffin (published by The Focal Press Co., Ltd. 1966), Making and Coating Photographic Emulsion, written by V. L. Zelikman, (published by The Focal Press Co., Ltd. 1964), and JP-A-58-127921 and JP-A-58-113926. That is, an acid method, a neutral method or an ammonia method may used, and the manner of reacting the soluble silver salt with the soluble halide may be a single mixing method, a double jet method or a combination thereof.

One may use the method of forming the silver halide grains in the presence of excessive silver ion (a so-called reverse mixing method). One can also use as one form of the double jet method, the method of maintaining pAg of a solution at a fixed level, in which silver halide is prepared, that is, a controlled double jet method. A silver halide emulsion consisting of the silver halide grains with a regular crystal form and an almost uniform grain size can be obtained with this method.

The crystal constitution of a silver halide grain may be uniform throughout the grain, of a stratum constitution in which an inside and a surface of the grain have a different composition, or a so-called conversion type described in British Patent 635,841 and U.S. Pat. No. 3,622,318. A cadmium salt, a zinc salt, a lead salt, a thallium salt, an iridium salt or a complex salt thereof, a rhodium salt or a complex salt thereof, and an iron salt or a complex salt thereof, may be present at the step of silver halide grain formation or at the step of physical ripening in manufacturing the silver halide.

Further, there may be present during grain formation a so-called silver halide solvent such as ammonia, a thioether compound, thiazolidine-2-thione, tetra-substituted thiourea, potassium rhodanide, ammonium rhodanide, and an amine compound to control a grain growth.

The silver halide emulsion used in the present invention may or may not be chemically sensitized. A sulfur sensitizing method, a reduction sensitizing method and a gold sensitizing method can be used as a chemical sensitizing method either singly or in combination thereof.

Among the noble metal sensitizing methods, the gold sensitizing method is a common one, in which a gold compound, primarily a gold complex salt, is used. There may be contained a noble metal other than gold, for example, a complex salt of platinum, palladium and iridium. Concrete examples thereof are described in U.S. Pat. No. 2,448,060 and British Patent 618,061.

There can be used as a sulfur sensitizing agent, various sulfur compounds, for example, thiosulfates, thioureas, thiazoles, and rhodanines as well as a sulfur compound contained in gelatin.

There can be used as a reducing agent, a stannous salt, amines, formaminedisulfinic acid, and a silane compound. Various compounds can be incorporated into the photographic emulsion used in the present invention for the purposes of preventing fog and stabilizing the photographic properties in preparing, storing and photographic processing of a light-sensitive material. That is, there can be added many compounds which are known as an antifoggant and a stabilizer, such as azoles (for example, a benzothiazolium salt, nitroimidazoles, nitro-benzimidazoles, chlorobenzimidazoles, bromobenzimidazoles, nitroindazoles, benzotriazoles, and aminotriazoles); mercapto compounds (for example, mercaptothiazoles, mercaptobenzothiazoles, mercaptobenzimidazoles, mercapto-thiadiazoles, mercaptotetrazoles (in particular, 1-phenyl-5-mercaptotetrazole), mercaptopyrimidines, and mercapto-triadines); thioketo compounds such as oxadolinethione; azaindenes (for example, triazaindenes, tetrazaindenes (in particular, 4-hydroxy-substituted (1,3,3a,7) tetrazaindenes), and pentazaindenes); and benzenethiosulfonic acid, benzenesulfinic acid, and benzenesulfonic acid amide.

Particularly preferably used are the nitrons and the derivatives thereof described in JP-A-60-76743 and JP-A-60-87322, the mercapto compounds described in JP-A-60-80839, the heterocyclic compounds described in JP-A-57-164735, and the complex salts of heterocyclic compounds and silver (for example, silver 1-phenyl-5-mercaptotetrazole).

The photographic emulsion layers and other hydrophilic colloid layers according to the present invention may contain various surface active agents for various purposes such as a coating aid, the prevention of electrification, improvement in sliding properties, emulsification and dispersion, the prevention of sticking, and improvement in photographic characteristics (for example, acceleration of development, hardening and sensitization).

There can be used, for example, a nonionic surface active agent such as saponin (a steroid type), an alkylene oxide derivative (for example, polyethylene glycol, a polyethylene glycol/polypropylene glycol condensation product, polyethylene glycol alkyl ethers, polyethylene glycol alkyl aryl ethers, and an adduct of silicon and polyethylene oxide), and alkyl esters of sucrose; an anionic surface active agent such as an alkylsulfonic acid salt, an alkylbenzenesulfonic acid salt, an alkylnaphthalenesulfonic acid salt, alkyl sulfuric acid esters, N-acyl-N-alkyltaurines, sulfosuccinic acid esters, and sulfoalkyl polyoxyethylenealkylphenyl ethers; an amphoteric surface active agent such as alkylbetaines and alkylsulfobetaines; and a cationic surface active agent such as an aliphatic or aromatic quaternary ammonium salt, pyridinium salts, and imidazolium salts.

Among them, there can be particularly preferred are an anionic surface active agent such as saponin, sodium dodecylbebzenesulfonate, sodium di-2-ethylhexyl-α-sulfosuccinate, sodium p-octylphenoxyethoxyethanesulfonate, sodium dodecylsulfate, sodium triisopropylnaphthalenesulfonate, and sodium N-methyl-oleyltaurine; a cationic surface active agent such as dodecyltrimethylammonium chloride, N-oleyl-N',N',N'-trimethylammoniodiaminopropane bromide, and dodecylpyridium chloride; betaines such as N-dodecyl-N,N-dimethylcarboxybetaine and N-oleyl-N,N-dimethylsulfobutylbetaine; and an nonionic surface active agent such as polyoxyethylene cetyl ether (an average polymerization degree n=10), polyoxyethylene-p-nonylphenol ether (n=25), and bis(1-polyoxyethylene-oxy-2,4-di-t-pentylphenyl) ethane (n=15).

There can be used as an antistatic agent, a fluorinated surface active agent such as potassium perfluoroctanesulfonate, sodium N-propyl-N-perfluoroctanesulfonyl glycine, sodium N-propyl-N-perfluoroctanesulfonylaminoethyloxy polyoxyethylene-butanesulfonate (n=3), N-perfluoroctane-sulfonyl-N',N',N'-trimethylammoniodiaminopropane chloride, and N-perfluorodecanoylaminopropyl-N',N'-dimethyl-N'-carboxybetaine; the nonionic surface active agents described in JP-A-60-80848, JP-A-61-112144, JP-A-62-172343 and JP-A-62-173459; alkali metal nitrates; electroconductive tin oxide; zinc oxide; vanadium hexaoxide; and composite oxides prepared by doping antimony to the above metal oxides.

In the present invention, there can be used as a matting agent, the fine particles of organic compounds such as a homopolymer of methyl methacrylate, a copolymer of methyl methacrylate and methacrylic acid, and starch, and inorganic compounds such as silica and titanium dioxide. The particle size thereof is preferably 1.0 to 10 mm, particularly preferably 2 to 5 mm.

There can be used as a sliding agent for a surface layer of the photographic light-sensitive material according to the present invention, the silicon compounds described in U.S. Pat. Nos. 3,489,576 and 4,047,958, and colloidal silica described in JP-B-56-23139, as well as paraffin wax, higher fatty acid ester and a starch derivative.

There can be used as a plasticizer for the hydrophilic colloid layers of the photographic light-sensitive material according to the present invention, polyols such as trimethylol propane, pentanediol, butanediol, ethylene glycol, and glycerine. Further, a polymer latex is preferably incorporated into the hydrophilic colloid layers of the photographic light-sensitive material according to the present invention for the purpose of improving the anti-pressure properties. There can be preferably used as the polymer, a homopolymer of acrylic acid alkyl ester or a copolymer thereof with acrylic acid, a copolymer of styrene and butadiene, and a homopolymer or copolymer consisting of monomers having an active methylene group.

The photographic emulsions and non-light-sensitive hydrophilic colloids used in the present invention may contain an inorganic or organic hardener. There can be used, for example, a chromium salt, aldehydes (for example, formaldehyde and glutaric aldehyde), an N-methylol compound (for example, dimethylol urea), an active vinyl compound (for example, 1,3,5-triacryloylhexahydro-s-triazine, bis(vinylsulfonyl) methyl ether, and N,N'-methylenebis[β-(vinylsulfonyl)propionamide]), an active halogen compound (for example, 2,4-dichloro-6-hydroxy-s-triazine), mucohalogen acids (for example, mucochloric acid), N-carbamoylpyridinium salts [for example, (1-morpholinocarbonyl- 3-pyridinio) methanesulfonate], and haloaminidium salts [for example, 1-(1-chloro-1-pyridinomethylene) pyrrolidinium and 2-naphthalenesulfonate]. They can be used either singly or in combination thereof. Among them, preferred are the active vinyl compounds described in JP-A-53-41220, JP-A-53-57257, JP-A-59-162546 and JP-A-60-80846, and the active halogen compounds described in U.S. Pat. No. 3,325,287.

The development processing method used in the present invention is not specifically limited, and there can be referred to, for example, the descriptions of page 16, a right upper column, 7th line to page 19, a left lower column, 15th line of JP-A-2-103037, page 3, a right lower column, 5th line to page 6, a right upper column, 10th line of JP-A-2-115837, and those described in U.S. Pat. No. 4,672,025.

EXAMPLES

The present invention will be explained below with reference to examples, but the embodiments of the present invention are not limited thereto.

EXAMPLE 1

1. Preparation of the emulsions

Emulsion 1: a monodispersed tabular emulsion

An aqueous solution (36 ml) containing $AgNO_3$ (3.3 g) and an aqueous solution (33 ml) containing KBr (3.0 g) and KI (0.36 g) were added under vigorous stirring to a 2.6 wt % gelatin solution (1 liter) containing KBr (4.5 g) and $HO(CH_2)_2S(CH_2)_2S(CH_2)_2OH$ (0.1 g) by a double jet method for 40 seconds. During this period, the reaction solution was maintained at 65° C. After addition was completed, the temperature was raised to 70° C. Further, an aqueous solution (54 ml) containing $AgNO_3$ (5 g) was added over 13 minutes and pBr was adjusted to 2.2.

A 25 wt % aqueous ammonia (23 ml) was added to provide a ripening for 10 minutes. After 10 minutes, pH was adjusted to 5.5 with acetic acid, and pBr was adjusted with KBr. Then, an aqueous solution (444 ml) containing $AgNO_3$ (133 g) and a 20 wt % KBr aqueous solution were simultaneously added at an accelerated speed (flow amount at the completion was 3.4 times as much as that at the start). During this period, pBr was controlled to 1.9. After the completion of addition, a 1 wt % KI aqueous solution (20 ml) and a 2N potassium rhodanide aqueous solution (15 ml) were added.

Thereafter, the emulsion thus prepared was cooled to 35° C. and washed according to a conventional flocculation method. Gelatin, a thickener and a preservative were added at 40° C. and pH was adjusted to 5.9. Then, 4-hydroxy-6-methyl-1,3,3a,7-tetrazaindene (140 mg) and the sensitizing dye I-2 (340 mg) were added at 56° C. to ripen for 10 minutes, and sodium thiosulfate 5 hydrate (3 mg), potassium rhodanide (118 mg) and chlorauric acid (2 mg) were added in sequence to ripen for 50 minutes, followed by cooling.

Emulsion 2: a monodispersed tabular fine grain emulsion

Emulsion 2 was prepared in the same manner as Emulsion 1 except that in the conditions for forming the nucleus, the gelatin concentration was changed to 1.6 wt % and the temperature of the reaction solution was changed from 70° C. to 40° C.

Emulsion 3: a polydispersed tabular emulsion

Emulsion 3 was prepared in the same manner as Emulsion 1 except that the temperature of the reaction solution during grain formation was changed from 70° C. to 75° C. and no aqueous ammonia was added. Emulsion 4: a polydispersed tabular fine grain emulsion Emulsion 4 was prepared in the same manner as Emulsion 3 except that the temperature of the reaction solution was changed from 75° C. to 55° C.

Emulsion 5: a monodispersed tabular emulsion with a large thickness

Emulsion 5 was prepared in the same manner as Emulsion 1 except that the temperature of the reaction solution during grain formation was changed from 65° C. to 55° C. and the amount of the 25 wt % aqueous ammonia was changed from 23 ml to 32 ml.

Emulsion 6: a monodispersed non-tabular fine grain emulsion

Sodium thiosulfate 5 hydrate (10 mg), potassium rhodanide (2 g) and glacial acetic acid (10 ml) were added to a 2 wt % gelatin solution (1 liter) containing KBr (5.3 g) and sodium paratoluenesulfinate (4 g), and an aqueous solution (14 ml) containing $AgNO_3$ (5.2 g) and an aqueous solution (7 ml) containing KBr (1.8 g) and KI (0.33 g) were added under vigorous stirring by a double jet method for 30 seconds. Then, an aqueous solution (12 ml) containing KI (1.2 g) was added.

Next, an aqueous solution (200 ml) containing $AgNO_3$ (78 g) and an aqueous solution (200 ml) containing KBr (50.6 g) and KI (3.65 g) were added for 15 minutes, wherein the $AgNO_3$ aqueous solution was added in advance by 1 minute. A 25 wt % aqueous ammonia (22 ml) was added to provide a ripening for 10 minutes. Subsequently, an aqueous solution containing $AgNO_3$ (117 g) and an aqueous solution containing KBr (82.3 g) were simultaneously added for 14 minutes. The temperature of the reaction solution was maintained at 70° C. throughout all steps.

The emulsion thus prepared was washed according to a conventional flocculation method. Gelatin, a thickener and a preservative were added and dispersed at 40° C., pH was adjusted to 8.9, and pAg was adjusted to 8.9.

Then, 4-hydroxy-6-methyl-1,3,3a,7-tetrazaindene (21 mg) and sensitizing dye I-2 (170 mg) were added at 55° C. to provide ripening for 10 minutes. Then sodium thiosulfate 5 hydrate (9 mg), potassium rhodanide (77 mg) and chlorauric acid (1.6 mg) were added in sequence to provide ripening for 50 minutes, and 4-hydroxy-6-methyl-1,3,3a,7-tetrazidene (70 mg) was added thereto, followed by cooling.

The physical properties of Emulsions 1 to 6 are shown in Table 1.

TABLE 1

| Item | | Emulsion No. 1 | 2 | 3 | 4 | 5 | 6 |
|---|---|---|---|---|---|---|---|
| Ratio of the tabular grains (area ratio) | % | 97 | 98 | 94 | 96 | 99 | 0 |
| Average diameter of a circle corresponding to a projected area | μm | 1.35* | 0.92* | 1.38* | 0.93* | 1.25* | 0.81 |
| Fluctuation coefficient of the diameter | % | 17* | 15* | 31* | 28* | 12* | 18 |
| Average grain thickness | μm | 0.25* | 0.22* | 0.16* | 0.14* | 0.31* | — |
| Average aspect ratio | | 5.6* | 4.5* | 8.3* | 7.0* | 4.3* | — |

*the average values of the tabular grains alone.

2. Preparation of a light-sensitive material

Emulsions 1 to 4 and 6 were used to prepare the following emulsion coating solutions.

An emulsion coating solution and a surface protective layer coating solution were applied by a simultaneous extrusion method onto a blue colored transparent support coated in advance on the side opposite to the emulsion layer with a back layer and a back surface protective layer. The emulsion layer was coated in a single layer or a plurality of layers so that the coated silver amount was as shown in Table 2. The surface protective layer was applied so that the composition thereof was as shown below.

| Emulsion coating solution | |
|---|---|
| Emulsion (Ag: 7.4 g, gelatin: 6.4 g) | 75 g |
| Sodium polystyrenesulfonate (an average molecular weight: 600,000) | 60 mg |
| Polyacrylamide (an average molecular weight: 45,000) | 1.2 g |
| Trimethylolpropane | 0.4 g |
| Potassium hydroquinone monosulfonate | 0.56 g |
| 2,6-Bis(hydroxyamino)-4-diethylamino-1,3,5-triazine | 5.4 mg |
| Hardener 1,2-bis(vinylsulfonylacetamide)ethane | 0.1 g |

| Surface protective layer | Coated amount/$m^2$ |
|---|---|
| Gelatin | 1.16 g |
| Polyacrylamide (an average molecular weight: 45,000) | 0.3 g |
| 4-Hydroxy-6-methyl-1,3,3a,7-tetrazaindene | 4.6 mg |
| Sodium polyacrylate (an average molecular weight: 400,000) | 21 mg |

-continued
| | |
|---|---|
| $C_{16}H_{33}O(CH_2CH_2O)_{10}H$ | 35 mg |
| $C_8F_{17}SO_3K$ | 5 mg |
| $C_8F_{17}SO_2N(C_3H_7)(CH_2CH_2O)_4-(CH_2)_4SO_3Na$ | 5 mg |
| $C_8H_{17}-C_6H_4-(OCH_2CH_2)_3-SO_3Na$ | 20 mg |
| Polymethyl methacrylate (an average grain size: 2.5 mm) | 67 mg |
| Proxel | 0.8 mg |
| Back layer | Coated amount/$m^2$ |
|---|---|
| Gelatin | 4 g |
| Snowtex C | 0.47 g |
| Proxel | 2 mg |
| Polystyrenesulfonic acid (an average molecular weight: 600,000) | 30 mg |
| Polymer latex (a copolymer of ethyl acrylate and methacrylic acid: 97/3) | 0.53 g |
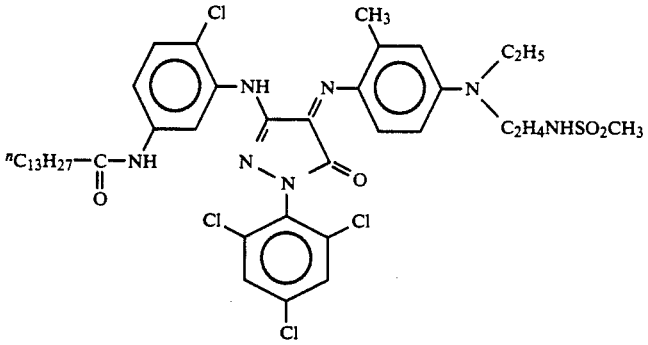
2.5 mg
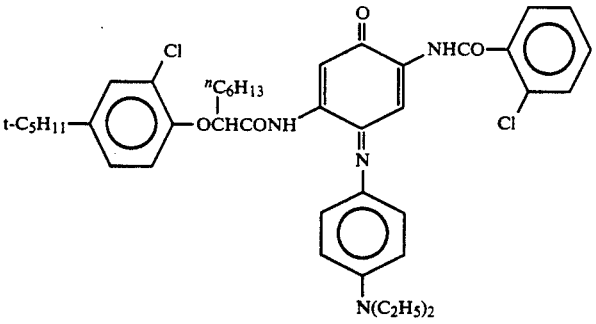
20 mg
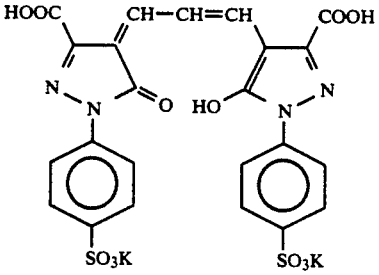
40 mg -continued

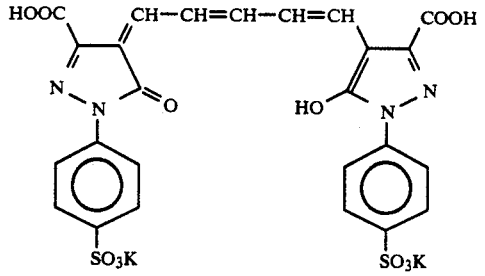

125 mg

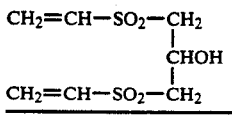

75 mg

| Back surface protective layer | Coated amount/$m^2$ |
|---|---|
| Gelatin | 1.28 g |
| Polymethyl methacrylate (an average grain size: 3.7 mm) | 64 mg |
| Proxel | 0.6 mg |
| $C_{16}H_{33}O(CH_2CH_2O)_{10}H$ | 40 mg |
| $C_8F_{17}SO_3K$ | 3 mg |
| Polystyrenesulfonic acid (an average molecular weight: 600,000) | 2 mg |
| $C_9H_{19}C_6H_4-O-(CH_2)_4SO_3Na$ | 14 mg |

TABLE 2

| Sample No. | Emulsion 1*1 Diameter μm 1.35 | 2*1 0.92 | 3*2 1.38 | 4*2 0.93 | 6*3 0.81 | Constitution of emulsion layer |
|---|---|---|---|---|---|---|
| 1 | 4 | 0 | 0 | 0 | 0 | Single layer/monodispersed tabular emulsion |
| 2 | 2 (1) | 1.6 (2) | 0 | 0 | 0 | Double layer/monodispersed tabular emulsions a lower layer: fine grains |
| 3 | 2 (2) | 1.6 (1) | 0 | 0 | 0 | Double layer/monodispersed tabular emulsions an upper layer: fine grains |
| 4 | 2 (1) | 1.6 (1) | 0 | 0 | 0 | Single layer/mixture of two monodispersed tabular emulsions |
| 5 | 0 | 0 | 3.7 | 0 | 0 | Single layer/polydispersed tabular emulsion |
| 6 | 0 | 0 | 4.5 | 0 | 0 | Single layer/polydispersed tabular emulsion coated silver amount: increased |
| 7 | 0 | 0.8 (1) | 3 (2) | 0 | 0 | Double layer/polydispersed tabular emulsion and monodispersed tabular fine grain emulsion |
| 8 | 0 | 1.6 (1) | 2 (2) | 0 | 0 | Double layer/polydispersed tabular emulsion monodispersed tabular fing grain emulsion |
| 9 | 0 | 0 | 2 (2) | 1.6 (1) | 0 | Double layer/two polydispersed tabular emulsions |
| 10 | 2 (2) | 0 | 0 | 1.6 (1) | 0 | Double layer/monodispersed tabular emulsion and polydispersed tabular fine grain emulsion |
| 11 | 2 (2) | 0 | 0 | 0 | 2 (1) | Double layer/monodispersed tabular emulsion and monodispersed non-tabular emulsion |

*1Monodispersed tabular emulsion.
*2Polydispersed tabular emulsion.
*3Monodispersed non-tabular emulsion.
Note:
The number outside the parenthesis represents the coated silver amount in terms of $g/m^2$.
The number in the parenthesis represents an emulsion layer, wherein a small number means an upper layer.

3. Sensitometry

Samples 1 to 11 were exposed through an acryl wedge via an HR-mammo cassette and an HR-mammo fine screen each manufactured by Fuji Photo Film Co., Ltd. with an X-ray generating equipment MGU-10C manufactured by Toshiba Co., Ltd. at a tube voltage of $26^{kv}$, a currency of $10^{mA}$ and an exposure time of 1.0 second. Then, the exposed samples were subjected to a processing in 90 seconds with an automatic processor FPM-5000 manufactured by Fuji Photo Film Co., Ltd. in a developing solution RD-3 to obtain a sensitometry curve. The processing conditions thereof were the same as the foregoing processing conditions X and the composition of the developing solution RD-3 in a running status was almost the same as that of the foregoing developing solution-1. The results are shown in Table 3.

4. Evaluation of distinguishability

A mammography phantom manufactured by C. G. R. Co. was photographed by Samples 1 to 11 via the same cassette and screen as those used in measuring the sensitometry with an X-ray generating equipment MGU-10 manufactured by Toshiba Co., Ltd. The development processing conditions were the same as those in the sensitometry.

The exposure time was adjusted by a sample at a tube valve focus size of 0.4 mm, a tube voltage of $26^{kv}$ and a currency of $100^{mA}$ so that the back density was 1.3. The determination of distinguishability was carried out with a loupe of 5 magnifications to evaluate the picturing property of a skin line, the picturing property of a micro calfication of 125 to 177 μm, the resolution of a fine line, and contrast resolution. The results are shown in Table 3.

The picturing property of the skin line and microcalfication are indicated by the following grades:

A: well visible
B: visible
C: hardly visible
D: invisible

The resolution of a fine line is indicated by distinguishable lines/mm (lp/mm).

Contrast resolution was evaluated by a picturing property of a pattern with a diameter of 1 mm having an X-ray absorption difference of 2% (a homogeneous X-ray of $20^{kv}$) and the results were classified to:

A: well visible
B: visible
C: hardly visible
D: invisible

The results are shown in Table 3.

TABLE 3

| Sample No. | Dmax | $\gamma_1$ (0.25-2.0) | $\gamma_2$ (0.25-0.5) | Skin line picturing property | Micro calficaion picturing property | Fine Line resolution lines/mm | Contrast resolution |
|---|---|---|---|---|---|---|---|
| 1 (Inv.) | 3.2 | 2.8 | 1.9 | B | B | 14.3 | B |
| 2 (Comp.) | 3.2 | 2.3 | 1.7 | B | D | 12.5 | D |
| 3 (Inv.) | 3.2 | 3.1 | 2.1 | B | B | 16.6 | A |
| 4 (Comp.) | 3.2 | 2.6 | 1.7 | B | C | 14.3 | D |
| 5 (Comp.) | 3.3 | 2.6 | 1.7 | B | C | 12.5 | D |
| 6 (Comp.) | 4.0 | 2.8 | 1.9 | C | B | 14.3 | C |
| 7 (Comp.) | 3.3 | 2.7 | 1.8 | B | C | 14.3 | C |
| 8 (Inv.) | 3.3 | 2.8 | 1.9 | B | B | 14.3 | C |
| 9 (Comp.) | 3.2 | 2.7 | 1.8 | B | C | 12.5 | C |
| 10 (Inv.) | 3.3 | 3.0 | 2.1 | B | B | 14.3 | B |
| 11 (Inv.) | 3.2 | 3.3 | 2.2 | B | A | 16.6 | A |

It can be found from the results summarized in Table 3 that Samples 1, 3, 8, 9, 10, and 11 have an excellent picturing property for mammography phantom. In particular, Samples 3 and 11, each having an emulsion layer structure in which a monodispersed emulsion was used and a fine grain emulsion as an upper layer, show an excellent image picturing property.

EXAMPLE 2

The emulsion coating solutions and surface protective layer coating solutions were prepared in the same manner as Example 1. Emulsions 1, 3, 5 and 6 were each prepared as in Example 1 and were applied so that the coated silver amounts were as shown in Table 4, whereby Samples 2-1 to 2-8 were prepared.

TABLE 4

| | Emulsion No. | | | |
|---|---|---|---|---|
| | 1 | 3 | 5 | 6 |
| | Diameter μ | | | |
| | 1.35 | 1.38 | 1.25 | 0.81 |
| | Thickness μ | | | |
| Sample No. | 0.25 | 0.16 | 0.30 | — |
| 2-1 | 4 | 0 | — | 0 |
| 2-2 | 0 | 3.7 | 0 | 0 |
| 2-3 | 0 | 4.0 | 0 | 0 |
| 2-4 | 0 | 0 | 4.0 | 0 |
| 2-5 | 0 | 0 | 5.0 | 0 |
| 2-6 | 2 | 0 | 0 | 2 |
| 2-7 | 0 | 1.8 | 0 | 2 |
| 2-8 | 0 | 0 | 2.5 | 2 |

Note:
The numbers in the table show the coated silver amounts ($g/m^2$).
Emulsion 6 was used for the upper layers in Samples 2-6 to 2-8.

Sensitometry and image quality were evaluated in the same manner as in Example 1. Also, image color tone was evaluated by a phantom image and was classified to:

B: cold black color tone
C: intermediate
D: yellowish black

TABLE 5

| Sample No. | Dmax | $\gamma_1$ (0.25-2.0) | $\gamma_2$ (0.25-0.5) | Skin life picturing property | Micro calficaion picturing property | Fine line resolution lines/mm | Contrast resolution | Image color tone |
|---|---|---|---|---|---|---|---|---|
| 2-1* | 3.2 | 2.8 | 1.9 | B | B | 14.3 | B | B |
| 2-2 | 3.3 | 2.6 | 1.7 | B | C | 12.5 | D | D |
| 2-3 | 3.7 | 2.7 | 1.7 | B-C | C | 14.3 | C | D |
| 2-4 | 2.6 | 2.2 | 1.8 | A | D | 12.5 | D | B |
| 2-5 | 3.2 | 2.5 | 1.8 | B | C | 14.3 | D | B |
| 2-6* | 3.2 | 3.2 | 2.2 | B | A | 16.6 | A | B |
| 2-7* | 3.2 | 2.9 | 1.9 | B | B | 14.3 | C | C |
| 2-8 | 3.2 | 2.7 | 2.0 | B | B | 14.3 | C | B |

*Sample having the characteristic curve according to the present invention.

In view of the results summarized in Table 5, the following comments may be made:

(1) Samples 2-2, 2-3 and 2-7, each comprising an emulsion containing tabular grains with an average thickness of 0.16 μm, had a yellowish image color tone and a contrast resolution which was visually decreased;

(2) Samples 2-4, 2-5 and 2-8, each comprising an emulsion containing the tabular grains with an average thickness of 0.31 μm, had an excellent image color tone, they must have a coated silver amount increased in order to give the needed maximum density (Dmax: 3.2). Further, it is difficult to increase $\gamma_1$(0.25-2.0), and a contrast resolution is not good;

(3) Samples 2-1 and 2-6 each comprising an emulsion containing the tabular grains with an average thickness of 0.25 μm are excellent either in image color tone or phantom picturing property;

(4) Samples 2-6 to 2-8, in each of which a monodispersed non-tabular emulsion was used for an upper layer, have better image color tone and image picturing property than Samples 2-1 to 2-5 in each of which it was not used.

It has been found from the above results that of the light-sensitive materials having the characteristic curves according to the present invention, the most preferable embodiment is Sample 2-6 and that the use of tabular grains having an appropriate grain thickness (0.2 to 0.3 μm) can provide a preferred image. Also, the use of a monodispersed non-tabular grains for an upper layer has provided further preferred results.

EXAMPLE 3

1. Preparation of a monodispersed tabular emulsion (Emulsions 7 to 11)

Emulsions 7 to 11 were prepared in the same manner as Emulsion 1 was prepared in Example 1, excepted that the addition amount of $AgNO_3$ added at the first stage with the double jet method was increased or decreased and the increased or decreased amount was adjusted in the addition at the second stage with the single jet method. The decrease in the amount of $AgNO_3$ added at the first stage with the double jet method resulted in an increase in the seed grains and the size of the finished grains. On the contrary, the increase in the addition amount thereof led to the reverse results. The sizes of the tabular grains were controlled in this manner to prepare Emulsions 7 to 11. The addition amounts of the sensitizing dye I-2, sodium thiosulfate, potassium rhodanide and chlorauric acid were optimized to the respective emulsions to provide chemical sensitization. The grain forms of Emulsions 7 to 11 are shown in Table 6.

TABLE 6

| Item | | Emulsion No. 7 | 8 | 9 | 10 | 11 |
|---|---|---|---|---|---|---|
| $AgNO_3$ amount added at the first stage with a double jet method | g | 2.5 | 3.3 | 3.8 | 4.3 | 4.8 |
| Ration of the tabular grains (area ratio) | % | 95 | 97 | 97 | 99 | 99 |
| Average diameter of a circle corresponding to the projected area | μm | 1.72 | 1.35 | 1.20 | 1.00 | 0.71 |
| Fluctuation coefficient of the diameter | % | 17 | 17 | 16 | 15 | 15 |
| Average grain thickness | μm | 0.25 | 0.25 | 0.24 | 0.23 | 0.23 |
| Average aspect ratio | | 7.3 | 5.6 | 5.0 | 4.5 | 3.2 |

2. Preparation of the coated samples

Coated samples were prepared with Emulsions 7 to 11 and Emulsion 6 (of Example 1) in the same manner as in Example 1 so that the coated amount was 4.0 g/m$^2$. Their relative sensitivity and covering power were examined, with results thereof shown in Table 7.

The coated silver amounts were adjusted based on the results of Table 7 to prepare Samples 3-1 to 3-7 in which the maximum densities and sensitivities in a density of 1 were adjusted.

TABLE 7

| Emulsion | Average circle-corresponding diameter (μm) | Covering*3 power (m$^2$/g) | Relative logarithmic sensitivity*4 |
|---|---|---|---|
| 7 | 1.72*1 | 0.70 | 0.08 |
| 8 | 1.35*1 | 0.80 | 0.00 |
| 9 | 1.20*1 | 0.87 | −0.10 |
| 10 | 1.00*1 | 0.95 | −0.22 |
| 11 | 0.71*1 | 1.10 | −0.40 |
| 6 | 0.81*2 | 0.80 | −0.22 |

*1tabular grains
*2solid grains
*3covering power at $D_{max}$: D/Ag amounts
*4Sensitivity is a logarithmic sensitivity of the density of 0.3 relative to that of Emulsion 8, which is set 0.00.

TABLE 8

| Sample No. | Emulsion an upper layer | Emulsion for a lower layer | Sensitivity difference* | Total silver |
|---|---|---|---|---|
| 3-1 | Em 9 (1.8) | Em 9 (1.8) | 0.00 | 3.60 |
| 3-2 | Em 11 (1.45) | Em 7 (2.3) | 0.48 | 3.75 |
| 3-3 | Em 10 (1.6) | Em 8 (2.0) | 0.22 | 3.60 |
| 3-4 | Em 6 (2.0) | Em 8 (2.0) | 0.22 | 4.00 |
| 3-5 | Em 10 (1.6) | Em 7 (2.3) | 0.30 | 3.90 |
| 3-6 | Em 9 (1.8) | Em 8 (2.0) | 0.10 | 3.80 |
| 3-7 | Em 6 (2.0) | Em 7 (2.3) | 0.30 | 4.30 |

*Difference of a relative logarithmic sensitivity between an emulsion for an upper layer and an emulsion for a lower layer.
Note: the numbers in a parenthesis represent the silver amounts (g/m$^2$).

TABLE 9

| Sample No. | Maximum density | Sensitivity* | $\gamma_1$ (0.25-2.0) | $\gamma_2$ (0.25-0.5) |
|---|---|---|---|---|
| 3-1 | 3.2 | 0.00 | 2.8 | 1 9 |
| 3-2 | 3.2 | 0.02 | 2.6 | 1.5 |
| 3-3 | 3.2 | 0.01 | 3.3 | 2.2 |
| 3-4 | 3.2 | 0.01 | 3.3 | 2.2 |
| 3-5 | 3.2 | 0.08 | 3.2 | 2.1 |
| 3-6 | 3.2 | 0.07 | 3.0 | 1.9 |
| 3-7 | 3.2 | 0.08 | 3.2 | 2.1 |

*Sensitivity is a logarithmic sensitivity at the density of 1.0 relative to that of Sample 3-1, which is set at 0.00.

The characteristics of Samples 3-1 to 3-7 are shown in Table 8 and the sensitometries thereof are shown in Table 9. The following conclusions may be drawn from the results summarized in Tables 7 to 9:

(1) In Samples 3-1 to 3-4 (each having a maximum density of 3.2 and a relative logarithmic sensitivity of 0 to 0.02), the gradations of Samples 3-3 and 3-4, each having an emulsion sensitivity difference of 0.22 between the upper layer and lower layer, were harder than that of Sample 3-1 comprising a single emulsion without increasing Dmax. On the contrary, the gradation of Sample 3-2 having an emulsion sensitivity difference of 0.48 between the upper layer and lower layer was softer.

(2) Samples 3-5 to 3-7 had high sensitivities and the gradations thereof were be harder without increasing Dmax. This was because the emulsion sensitivity difference between the upper layer and lower layer was optimized to 0.1 to 0.3.

It has been found from the above results that the sensitivity of a lower layer can be more increased by 0.1 to 0.4 in terms of logarithmic sensitivity above that of an upper layer to harden the gradations without increasing Dmax.

EXAMPLE 4

Evaluation of a pressure property

Samples 3-1 to 3-7 prepared in Example 3 were subjected to a humidity conditioning at the conditions of 25° C. and 25% RH for 1 hour, and were then folded at an angle of 180° around a stainless steel pipe with a diameter of 6 mm at the same conditions. The folding was carried out in such a manner that the samples were folded at 180° in one second and put back to the initial state in one second. The samples subjected to the folding were subjected 30 minutes later to the same processing as that carried out when the photographic properties had been evaluated.

Thereafter, the increase in density of a portion blackened in the form of a belt along the pipe was measured with a Macbeth densitometer. The results are shown in Table 10.

Samples 3-1 and 3-7 being subjected to a humidity conditioning at the conditions of 25° C. and 25% RH each were scratched with a sapphire needle having a diameter of 0.3 mm under a load of 50 g at a speed of 10 cm/second. The scratched samples were processed in the same manner as in the evaluation of photographic performance. The increase in density on the scratched (blackened) portion was measured using microdensitometer. The results are shown in Table 10.

TABLE 10

| Sample No. | | Density increase by folding | Density increase by scratching |
|---|---|---|---|
| 3-1 | Single layer/tabular grain emulsion with an average diameter of 1.20 μm | 0.15 | 0.25 |
| 3-2 | Double layer/tabular grain emulsions with average diameters of 0.71 μm and 1.72 μm | 0.14 | 0.10 |
| 3-3 | Double layer/tabular grain emulsions with average diameters of 1.00 μand 1.35 μm | 0.10 | 0.12 |
| 3-4 | Double layer/solid grain emulsion with average diameter of 0.81 μm and tabular grain emulsion with average diameter of 1.35 μm | 0.05 | 0.01 |
| 3-5 | Double layer/tabular grain emulsions with average diameters of 1.00 μm and 1.72 μm | 0.14 | 0.13 |
| 3-6 | Double layer/tabular grain emulsions with average diameters of 1.20 μm and 1.35 μm | 0.13 | 0.25 |
| 3-7 | Double layer/solid grain emulsion with average diameter of 0.81 μm and tabular grain emulsion with average diameter of 1.72 μm | 0.08 | 0.03 |

One can conclude from the results summarized in Table 10 that Samples 3-2 to 3-4, each having a multilayer structure, had a stronger durability against folding and scratching than Sample 3-1 having a single layer structure.

As shown in Table 9, Samples 3-5 and 3-6 have high sensitivities of 0.06 to 0.08 in terms of a logarithmic sensitivity as compared with Sample 3-1 and show an equal or higher pressure property and a better relationship of a sensitivity vs. pressure.

Also, Samples 3-4 and 3-7, in which a solid grain emulsion with an average grain size of 0.81 μm was used for an upper layer, have the best anti-pressure property.

EXAMPLE 5

Emulsions 1 and 6 each prepared in Example 1 were used to prepare the following emulsion coating solutions. A lower layer containing Emulsion 1, an upper layer containing Emulsion 6 and an uppermost surface protective layer were coated in the same manner as Example 1 by a simultaneous extrusion method on a blue colored transparent support. The support was coated in advance on the side opposite to the emulsion layer with a back layer containing a dye and a back surface protective layer, to thereby obtain Samples 5-1 to 5-22. The coated silver amounts were controlled so that those of the upper layer and the lower layer were 2.0 g/m$^2$, respectively. The gelatin amount of the surface protective layer was controlled to 0.92 g/m$^2$ (Table 11).

| Emulsion coating solution | Added amount/mole of Ag: Upper layer | Lower layer |
|---|---|---|
| Emulsion | Em 6: 1094 g | Em 1: 1094 g |
| Polyacrylamide (an average molecular weight: 45,000) | 17.5 g | 17.5 g |
| 2,6-Bis(hydroxyamine)-4-diethylamino-1,3,5-triazine | 79 mg | 79 mg |
| Hardener 1,2-Bis(vinylsulfonyl-acetamide)ethane | 1.46 g | 1.46 g |
| Sodium polystyrenesulfonate (an average molecular weight: 600,000) | 0.9 g | 0.9 g |
| Polymer latex (a copolymer of ethyl acrylate/methacrylic acid: 97/3) | — | 11.1 g |
| Potassium hydroquinone monosulfonate | — | 8.2 g |
| Trimethylolpropane | 5.8 g | 5.8 g |
| Compound of Formula (II) | as shown in Table 11 | |
| Dye of Formula (III) | as shown in Table 11 | |
| $C_9H_{19}-C_6H_4O-(CH_2CH_2O)_{12}H$ | 58 mg | — |

| Surface protective layer | Coated amount/m$^2$ |
|---|---|
| Gelatin | 0.92 g |
| Polyacrylamide (an average molecular weight: 45,000) | 0.3 g |
| 4-Hydroxy-6-methyl-1,3,3a,7-tetrazaindene | 4.6 mg |
| Sodium polyacrylate (an average molecular weight: 400,000) | 21 mg |
| Polymethyl methacrylate | 32 mg |

-continued

| | |
|---|---|
| (an average grain size: 2.5 μm) Proxel | 0.8 mg |
| 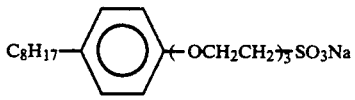 | 10 mg |
| 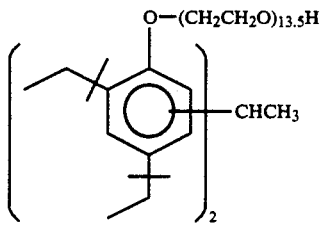 | 30 mg |
| $C_8F_{17}SO_2N(C_3H_7)(CH_2CH_2O)_4(CH_2)_4SO_3Na$ | 1.5 mg |
| $C_8F_{17}SO_2N(C_3H_7)(CH_2CH_2O)_{15}H$ | 2 mg |

The respective samples thus prepared were subjected to the photographic processing and then to a measurement of the photographic properties. The results are shown in Table 12.

TABLE 12-continued

| Sample No. | Sensitivity*1 | Fog*2 | $\gamma_1$ (0.25–2.0) | $\gamma_2$ (0.25–0.5) | Dmax |
|---|---|---|---|---|---|
| 5-13 | −0.02 | 0.010 | 3.3 | 2.4 | 3.2 |
| 5-14 | −0.03 | 0.015 | 3.2 | 2.3 | 3.2 |
| 5-15 | −0.02 | 0.015 | 3.2 | 2.3 | 3.2 |
| 5-16 | −0.03 | 0.015 | 3.2 | 2.3 | 3.2 |
| 5-17 | −0.03 | 0.015 | 3.2 | 2.4 | 3.2 |
| 5-18 | 0.00 | 0.040 | 3.1 | 2.1 | 3.2 |
| 5-19 | −0.01 | 0.035 | 3.1 | 2.2 | 3.2 |
| 5-20 | −0.01 | 0.010 | 3.3 | 2.4 | 3.3 |
| 5-21 | 0.00 | 0.025 | 3.2 | 2.2 | 3.2 |
| 5-22 | −0.01 | 0.010 | 3.4 | 2.4 | 3.3 |

*1Sensitivity is a logarithmic sensitivity which is defined by the logarithm of the reciprocal of the exposure necessary to obtain the density of fog + 1.0 and is shown by a value relative to that of Sample 5-1, which is set at 0.00.
*2Fog of an emulsion layer alone.

Samples 5-2 to 5-22 each containing a compound of Formula (II) and/or a dye of Formula (III) showed a particularly reduced fog and an increased gamma ($\gamma_2$) in a lower density portion in comparison with Sample 5-1 which did not contain the compound and dye, while causing a slight desensitization (0.00 to 0.03 in terms of log E).

A mammography phantom was photographed with a low pressure X-ray source ($26^{kv}$) to evaluate distinguishability. A comparison of Samples 5-4, 5-6, 5-13, 5-20 and 5-22, each having an increased $\gamma_1$ and $\gamma_2$ and a decreased fog, with Sample 5-1 showed that they were clearly excellent in micro calfication picturing property and contrast resolution.

TABLE 11

| Sample | Upper emulsion layer (Emulsion 6) | | | | Lower emulsion layer (Emulsion 1) | | | |
|---|---|---|---|---|---|---|---|---|
| | Compound (II) | | Dye (III) | | Compound (II) | | Dye (III) | |
| No. | No. | Added amount | No. | Added amount | No. | Added amount | No. | Added amount |
| 5-1 | — | — | — | — | — | — | — | — |
| 5-2 | — | — | — | — | II-14 | $0.35 \times 10^{-4}$ | — | — |
| 5-3 | — | — | — | — | II-14 | $0.70 \times 10^{-4}$ | — | — |
| 5-4 | — | — | — | — | II-14 | $1.40 \times 10^{-4}$ | — | — |
| 5-5 | — | — | — | — | II-16 | $1.40 \times 10^{-4}$ | — | — |
| 5-6 | — | — | — | — | II-13 | $1.40 \times 10^{-4}$ | — | — |
| 5-7 | — | — | — | — | II-2 | $1.40 \times 10^{-4}$ | — | — |
| 5-8 | — | — | — | — | II-3 | $1.40 \times 10^{-4}$ | — | — |
| 5-9 | II-14 | $0.35 \times 10^{-4}$ | — | — | — | — | — | — |
| 5-10 | II-14 | $0.70 \times 10^{-4}$ | — | — | — | — | — | — |
| 5-11 | II-14 | $1.40 \times 10^{-4}$ | — | — | — | — | — | — |
| 5-12 | — | — | — | — | — | — | III-30 | $1.5 \times 10^{-4}$ |
| 5-13 | — | — | — | — | — | — | III-30 | $3.0 \times 10^{-4}$ |
| 5-14 | — | — | — | — | — | — | III-13 | $3.0 \times 10^{-4}$ |
| 5-15 | — | — | — | — | — | — | III-3 | $3.0 \times 10^{-4}$ |
| 5-16 | — | — | — | — | — | — | III-14 | $3.0 \times 10^{-4}$ |
| 5-17 | — | — | — | — | — | — | III-31 | $3.0 \times 10^{-4}$ |
| 5-18 | — | — | III-30 | $1.5 \times 10^{-4}$ | — | — | — | — |
| 5-19 | — | — | III-30 | $3.0 \times 10^{-4}$ | — | — | — | — |
| 5-20 | — | — | — | — | II-14 | $0.7 \times 10^{-4}$ | III-30 | $1.5 \times 10^{-4}$ |
| 5-21 | II-14 | $0.7 \times 10^{-4}$ | III-30 | $1.5 \times 10^{-4}$ | — | — | — | — |
| 5-22 | II-14 | $0.7 \times 10^{-4}$ | III-30 | $1.5 \times 10^{-4}$ | II-14 | $0.7 \times 10^{-4}$ | III-30 | $1.5 \times 10^{-4}$ |

Note:
added amount: mole/mole of Ag

TABLE 12

| Sample No. | Sensitivity*1 | Fog*2 | $\gamma_1$ (0.25–2.0) | $\gamma_2$ (0.25–0.5) | Dmax |
|---|---|---|---|---|---|
| 5-1 | 0.00 | 0.050 | 3.1 | 2.0 | 3.2 |
| 5-2 | 0.00 | 0.032 | 3.2 | 2.1 | 3.2 |
| 5-3 | −0.01 | 0.021 | 3.2 | 2.2 | 3.2 |
| 5-4 | −0.02 | 0.010 | 3.3 | 2.4 | 3.3 |
| 5-5 | −0.02 | 0.013 | 3.2 | 2.3 | 3.3 |
| 5-6 | −0.04 | 0.021 | 3.3 | 2.4 | 3.3 |
| 5-7 | −0.02 | 0.017 | 3.2 | 2.2 | 3.3 |
| 5-8 | −0.01 | 0.015 | 3.2 | 2.2 | 3.3 |
| 5-9 | 0.00 | 0.042 | 3.1 | 2.1 | 3.2 |
| 5-10 | 0.00 | 0.035 | 3.1 | 2.2 | 3.2 |
| 5-11 | −0.01 | 0.030 | 3.1 | 2.2 | 3.2 |
| 5-12 | −0.01 | 0.020 | 3.2 | 2.2 | 3.2 |

EXAMPLE 6

Samples 5-1 to 5-8 prepared in Example 5 were evaluated for their pressure properties in the same manner as in Example 4. The results are shown in Table 13.

TABLE 13

| Sample No. | Lower emulsion layer Compound II | amount | Density increase by folding | Density increase by scratching |
|---|---|---|---|---|
| 5-1 | — | — | 0.10 | 0.04 |
| 5-2 | II-14 | $0.35 \times 10^{-4}$ | 0.08 | 0.04 |
| 5-3 | II-14 | $0.70 \times 10^{-4}$ | 0.06 | 0.04 |

TABLE 13-continued

| Sample No. | Lower emulsion layer Compound II | amount | Density increase by folding | Density increase by scratching |
|---|---|---|---|---|
| 5-4 | II-14 | $1.40 \times 10^{-4}$ | 0.04 | 0.03 |
| 5-5 | II-16 | $1.40 \times 10^{-4}$ | 0.04 | 0.03 |
| 5-6 | II-13 | $1.40 \times 10^{-4}$ | 0.08 | 0.03 |
| 5-7 | II-2 | $1.40 \times 10^{-4}$ | 0.06 | 0.03 |
| 5-8 | II-3 | $1.40 \times 10^{-4}$ | 0.05 | 0.04 |

Samples 5-2 to 5-8 in each of which Compounds II-14, II-16, II-13, II-2 and II-3 were incorporated into the lower emulsion layers had less increase in density particularly by folding in comparison with Sample 5-1 containing none of the above compounds.

EXAMPLE 7

Preparation of the emulsions

Emulsions 12 to 15 were prepared in the same manner as Emulsion 1 was prepared in Example 1, except that the silver halide compositions of the tabular grains contained in the outermost layers were changed as shown in Table 14 and that the sensitizing dye I-2 was added in the amounts shown in Table 14.

Further, Emulsions 16 to 18 were prepared in the same manner as Emulsion 2 prepared in Example 1, except that the same changes as those made in Emulsions 12 to 15 were applied. The physical properties of the grains including the grain forms and average halogen compositions are shown in Table 14.

Preparation of the light-sensitive materials

The emulsion layers containing Emulsions 1, 2 and 12 to 18 and surface protective layers were coated in the same manner as in Example 5 on the support having the same back layer and back protective layer as those in Example 5, whereby the samples having the emulsion layer constitutions shown in Table 14 were prepared.

The composition of the emulsion layer coating solution is shown below:

| Emulsion layer coating solution | Coated amount/ mole of Ag |
|---|---|
| Emulsion | 1094 g |
| Polyacrylamide (an average molecular weight: 45,000) | 17.5 g |
| 2,6-Bis(hydroxyamino)-4-diethylamino-1,3,5-triazine | 79 mg |
| Hardener | |
| 1,2-Bis(vinylsulfonylacetamide) ethane | 1.46 g |
| Sodium polystyrenesulfonate (an average molecular weight: 600,000) | 0.9 g |
| Polymer latex (a copolymer of ethyl acrylate/ methacrylate acid: 97/3) | 11.1 g |
| Potassium hydroquinone monosulfonate | 8.2 g |
| Trimethylolpropane | 5.8 g |
| Ka-37 | 39.2 mg |

TABLE 14

| Emulsion No. | Gelatin conc. in forming nucleus (wt %) | Iodide* content in outermost layer (mol %) | Added amount of I-2 (mg/mol) | Average iodide content (mol %) | Average diameter of circle corresponding to projected area (μm) | Average thickness (μm) | Aspect ratio |
|---|---|---|---|---|---|---|---|
| 1 | 2.6 | 0 | 409 | 0.40 | 1.35 | 0.25 | 5.6 |
| 12 | 2.6 | 1 | 409 | 1.34 | 1.36 | 0.24 | 5.8 |
| 13 | 2.6 | 2 | 409 | 2.28 | 1.33 | 0.23 | 5.7 |
| 14 | 2.6 | 0 | 250 | 0.40 | 1.35 | 0.25 | 5.6 |
| 15 | 2.6 | 0 | 650 | 0.40 | 1.35 | 0.25 | 5.6 |
| 2 | 1.6 | 0 | 409 | 0.40 | 0.92 | 0.22 | 4.5 |
| 16 | 1.6 | 1 | 409 | 1.34 | 0.95 | 0.21 | 4.7 |
| 17 | 1.6 | 2 | 409 | 2.28 | 0.93 | 0.21 | 4.3 |
| 18 | 1.6 | 3 | 409 | 3.22 | 0.95 | 0.21 | 4.7 |

*The iodide content in the outermost layer means the iodide content in the halide solution used for growing a grain by adding a silver nitrate solution and a halide solution after nucleus formation, growing of the nucleus and ripening of the nucleus, in the formation of the tabular grains.

TABLE 15

| Sample No. | Emulsion in upper layer | Emulsion in lower layer | Iodide content upper/lower/ave. | Remarks |
|---|---|---|---|---|
| 7-1 | 1 (2) | 1 (2) | 0.4/0.4/0.4 | Single layer/high sensitive emulsion |
| 7-2 | 12 (2) | 12 (2) | 1.34/1.34/1.34 | Single layer/high sensitive emulsion |
| 7-3 | 13 (2) | 13 (2) | 2.28/2.28/2.28 | Single layer/high sensitive emulsion |
| 7-4 | 14 (2) | 14 (2) | 0.4/0.4/0.4 | Single layer/high sensitive emulsion |
| 7-5 | 15 (2) | 15 (2) | 0.4/0.4/0.4 | Single layer/high sensitive emulsion |
| 7-6 | 2 (1.6) | 2 (1.6) | 0.4/0.4/0.4 | Single layer/fine grain emulsion |
| 7-7 | 16 (1.6) | 16 (1.6) | 1.34/1.34/1.34 | Single layer/fine grain emulsion |
| 7-8 | 17 (1.6) | 17 (1.6) | 2.28/2.28/2.28 | Single layer/fine grain emulsion |
| 7-9 | 18 (1.6) | 18 (1.6) | 3.22/3.22/3.22 | Single layer/fine grain emulsion |
| 7-10 | 2 (1.6) | 1 (2) | 0.4/0.4/0.4 | Iodide content in upper layer was changed |
| 7-11 | 16 (1.6) | 1 (2) | 1.34/0.4/0.82 | |
| 7-12 | 17 (1.6) | 1 (2) | 2.28/0.4/1.23 | |
| 7-13 | 18 (1.6) | 1 (2) | 3.22/0.4/1.65 | |
| 7-14 | 2 (1.6) | 12 (2) | 0.4/1.34/0.92 | Iodide content and a dye amount in a lower layer were changed |
| 7-15 | 2 (1.6) | 13 (2) | 0.4/2.28/1.44 | |
| 7-16 | 2 (1.6) | 14 (2) | 0.4/0.4/0.4 | |
| 7-17 | 2 (1.6) | 15 (2) | 0.4/0.4/0.4 | |

Note: Iodide content: mol %. Number in a parenthesis: silver amount ($g/m^2$).

Evaluation of photographic properties and residual dye color

Samples 7-1 to 7-17 were exposed in the same manner as in Example 1 to an X-ray via an HR-mammo fine screen with an X-ray generating device at a tube voltage of $26^{kv}$ and were subjected to 90 seconds of processing with an automatic processor FPM-5000. Further, the samples were subjected to 60 seconds of processing with a modified automatic processor FPM-5000 in which the revolution number of the motor was changed. The processing time means a dry to dry time, that is, the time from the beginning of dipping the top end of the photographic material to be processed in the developer tank to the finish of taking out the top end of the same from the drying zone.

The photographic performances with the 90 second processing are shown in Table 16. The 60 second processing gave the almost same results in $\gamma_1$, $\gamma_2$, and the maximum density as those of the 90 second processing, except that the 60 second processing provided a desensitization by about 0.02 in terms of log E.

Further, the results of the residual dye color are shown in Table 16, wherein the results are classified according to the following three grades:

B: no residual dye color

C: intermediate

D: distinctly residual dye color

TABLE 16

| Sample No. | Processing (90 sec., 35° C.) $\gamma_1$ (0.25–2.0) | $\gamma_2$ (0.25–0.5) | Sensitivity (D = 1) | Dmax | Residual color | Processing (60 sec.) Residual color | Remarks |
|---|---|---|---|---|---|---|---|
| 7-1 | 2.8 | 1.9 | 0.00 | 3.2 | B | B | Single layer/high sensitive emulsion |
| 7-2 | 2.9 | 2.0 | 0.03 | 3.2 | C | D | Single layer/high sensitive emulsion |
| 7-3 | 3.0 | 2.1 | 0.05 | 3.2 | D | D | Single layer/high sensitive emulsion |
| 7-4 | 2.3 | 1.5 | −0.15 | 2.8 | B | B | Single layer/high sensitive emulsion |
| 7-5 | 2.8 | 1.9 | 0.01 | 3.2 | C | D | Single layer/high sensitive emuslion |
| 7-6 | 2.8 | 1.9 | −0.31 | 3.2 | B | B | Single layer/fine grain emulsion |
| 7-7 | 3.0 | 2.0 | −0.29 | 3.2 | C | D | Single layer/fine grain emulsion |
| 7-8 | 3.1 | 2.1 | −0.27 | 3.2 | D | D | Single layer/fine grain emulsion |
| 7-9 | 3.3 | 2.3 | −0.24 | 3.2 | D | D | Single layer/fine grain emulsion |
| 7-10 | 3.2 | 2.2 | −0.16 | 3.2 | B | B | Iodide content in an upper layer was changed |
| 7-11 | 3.4 | 2.3 | −0.15 | 3.2 | B | B | |
| 7-12 | 3.4 | 2.4 | −0.15 | 3.2 | B | B | |
| 7-13 | 3.5 | 2.5 | −0.14 | 3.2 | B | C | |
| 7-14 | 3.3 | 2.3 | −0.16 | 3.2 | C | D | Iodide content and a dye amount in an upper layer were changed |
| 7-15 | 3.4 | 2.3 | −0.15 | 3.2 | D | D | |
| 7-16 | 2.5 | 1.6 | −0.21 | 3.0 | B | B | |
| 7-17 | 3.2 | 2.2 | −0.16 | 3.2 | B | C | |

The following conclusions may be drawn from the results summarized in Table 16:

(1) Of Samples 7-10 and 7-17 each having a constitution according to the present invention, in which a fine grain emulsion was used for an upper layer and a high sensitive emulsion was used for a lower layer, Samples 7-10 to 7-13 having an iodide content of 0.4 mol % in the emulsion contained in the lower layer had no residual color in the 90 seconds processing and 60 seconds processing even with the iodide content set at 2 to 3 mol % in an emulsion contained in the upper layer. Meanwhile, the increase in the iodide content in the emulsion contained in the upper layer provides the advantage that a processing performance of a harder gradation can be obtained.

(2) The setting of the iodide content in the emulsion contained in the lower layer at 1 to 2 mol % generates a residual color even with the lowered iodide content in the emulsion contained in the upper layer.

(3) The most preferable addition amount of a dye to the emulsion in the lower layer is 400 mg/mole of Ag. The decreased addition amounts thereof (Samples 7-4 and 7-16) cause a lowering of sensitivity and gamma. The addition of excessive amounts (Samples 7-5 and 7-17) generates a residual dye color.

The decrease in the iodide content in the emulsion contained in the lower layer of the light-sensitive material having the multi-emulsion layer structure according to the present invention has enabled improvement in both photographic performance and residual color performance and has enabled rapid processing.

EXAMPLE 8

Evaluation of storing property

Samples 7-10 to 7-15 prepared in Example 7 were subjected to 90 second processing and 60 second processing to check their storing property.

Measurement of residual hypo

The respective samples were dipped in the following solutions A, B and C in order for one minute at 25° C. and then washed in flowing water for 3 minutes to measure the density difference between the dipped portion and the undipped portion after drying.

| Soluiton A | Solution B | Solution C |
|---|---|---|
| Silver nitrate: 10 g<br>Glacial acetic: 30 ml acid<br>Water: 1 liter | NaCl: 45 g<br>Water: 1 liter | Hypo anhyd.: 45 g<br>Sodium sulfite: 15 g<br>Water: 1 liter |

Measurement of residual silver

The respective samples were dipped in a solution containing sodium sulfide (2 g) in water (1 liter) for 1 minute and washed in flowing water for 3 minutes to measure the density difference between the dipped portion and the undipped.

The results are shown in Table 17.

TABLE 17

| Sample No. | Iodide content mol % Upper/lower/average | 90 seconds processing (35° C.) Residual hypo | Residual silver | 60 seconds processing (35° C.) Residual hypo | Residual silver |
|---|---|---|---|---|---|
| 7-10 | 0.4/0.4/0.4 | 0.01 | 0.00 | 0.03 | 0.01 |
| 7-11 | 1.34/0.4/0.82 | 0.02 | 0.00 | 0.04 | 0.02 |
| 7-12 | 2.28/0.4/1.23 | 0.03 | 0.01 | 0.06 | 0.03 |
| 7-13 | 3.22/0.4/1.65 | 0.05 | 0.02 | 0.08 | 0.05 |
| 7-14 | 0.4/1.34/0.92 | 0.06 | 0.03 | 0.09 | 0.07 |
| 7-15 | 0.4/2.28/1.44 | 0.10 | 0.05 | 0.15 | 0.10 |

The following can be determined from the results summarized in Table 17: the residual hypo and residual silver increase according to the increase in the iodide content of silver halide, and they markedly increase with the increase in the iodide content in the emulsion contained in the lower layer. The setting of the iodide content of the emulsion contained in the lower layer at 0.4 mol % provides less of an increase in residual hypo and residual silver even with the iodide content in the emulsion contained in the upper layer set at 2 to 3 mol %, and the storing property can be maintained at a sufficiently high level even with the 60 second processing.

As shown in Example 7, an increase in the iodide content in silver halide of the emulsion contained in the upper layer can provide the light-sensitive material having a harder gradation.

What is claimed is:

1. A method for forming an X-ray image by subjecting a light-sensitive material comprising a support having provided thereon a light-sensitive silver halide emulsion layer containing a silver halide emulsion sensitized with a sensitizing dye represented by the following Formula (I) on only one side of the support, to photographing via a green color emission fluorescent screen with an X-ray emitted from an X-ray generating device with a tube voltage of $25^{kv}$ or more and $40^{kv}$ or less, wherein in the characteristic curve represented by a rectangular coordinate constituted by optical density and logarithmic exposure, an average gradation shown by a gradient of a line drawn by connecting the point at which 0.25 is added to the minimum density (hereinafter referred to as Dmin) to the point at which 2.0 is added to Dmin is set at 2.8 to 3.6; an average gradation shown by a gradient of a line drawn by connecting the point at which 0.25 is added to Dmin to the point at which 0.5 is added to Dmin is set at 1.9 or more; and the maximum density is set at 2.8 to 3.3:

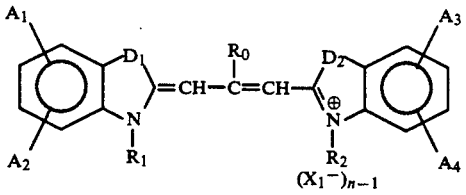

(I)

wherein $A_1$, $A_2$, $A_3$ and $A_4$ each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyl group, an acyloxyl group, an alkoxycarbonylamino group, or a carboalkoxy group; $A_1$ and $A_2$, and $A_3$ and $A_4$ may combine with each other to form a naphthoxazole group; $R_0$ represents a hydrogen atom, a lower alkyl group or an aryl group; $D_1$ and $D_2$ each represents an oxygen atom or a sulfur atom; $R_1$ and $R_2$ each represents an alkyl group, provided that at least one of $R_1$ and $R_2$ is an alkyl group having a sulfo radical; $X_1$ represents an anion; and n represents 1 or 2, provided that when n is 1, the dye forms an intermolecular salt; and then subjecting the material to developing.

2. The method of claim 1, wherein the silver halide emulsion is a monodispersed silver halide emulsion which has a fluctuation coefficient (a standard deviation of a grain diameter of a circle corresponding to the projected area/an average grain diameter) of 20% or less.

3. The method of claim 1, wherein the silver halide emulsion is a monodispersed silver halide emulsion comprising tabular grains having an average aspect ratio (a diameter of a circle corresponding to a projected area/an average grain thickness) of 3 or more, a grain thickness of 0.2 μm to 0.3 μm, and a fluctuation coefficient of the diameter of 20% or less.

4. The method of claim 1, wherein the light-sensitive silver halide emulsion layer consists of two or more light-sensitive layers, and the sensitivity of a lower light-sensitive layer is higher by 0.1 to 0.4 in terms of a relative logarithmic sensitivity than that of the upper light-sensitive layer adjacent thereto.

5. The method of claim 4, wherein the light-sensitive layer closest to the support contains a monodispersed silver halide emulsion and the uppermost light-sensitive layer contains a monodispersed non-tabular emulsion having an aspect ratio of 3 or less.

6. The method of claim 1, wherein the light-sensitive silver halide emulsion substantially contains at least one compound represented by the following Formula (II) and/or at least one compound represented by the following Formula (III):

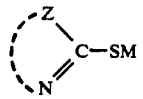

(II)

wherein Z represents a group of atoms necessary to form a 5- or 6-membered ring; and M represents a hydrogen atom, an alkali metal atom or an ammonium group;

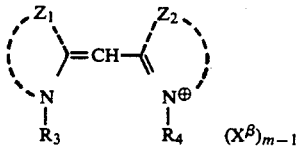

(III)

wherein, $Z_1$ and $Z_2$ each represents a group of non-metallic atoms necessary to complete a thiazole nucleus, a thiazoline nucleus, an oxazole nucleus, a selenazole nucleus, a 3,3-dialkylindolenine nucleus, an imidazole nucleus, and a pyridine nucleus; $R_3$ and $R_4$ each represent an alkyl group; $X_2$ represents an anion; and m represents 1 or 2, provided that m is 1 when the dye forms an intermolecular salt.

7. The method of claim 4, wherein an emulsion of the lowest layer comprises (a) a mono-dispersed tabular silver halide emulsion containing tabular silver iodobromide particles having an average iodide content in the particle of 0.5 mol % or less and (b) at least one sensitizing dye represented by formula (I) in a total amount of 300 mg to 600 mg per mole of the silver in the emulsion.

8. The method of claim 7, wherein the developing step occurs in a total processing time (Dry to Dry time) of 90 seconds or less.

* * * * *